US009939748B2

(12) United States Patent
Tanaka et al.

(10) Patent No.: US 9,939,748 B2
(45) Date of Patent: Apr. 10, 2018

(54) IMAGE FORMING APPARATUS THAT CONTROLS POSTURE OF INTERMEDIATE TRANSFER MEMBER AND IMAGE FORMATION POSITION BASED ON RESULTS OF DETECTION OF PREDETERMINED PORTION OF INTERMEDIATE TRANSFER MEMBER

(71) Applicant: CANON KABUSHIKI KAISHA, Tokyo (JP)

(72) Inventors: Koichi Tanaka, Kashiwa (JP); Jiro Shirakata, Chigasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/498,706

(22) Filed: Apr. 27, 2017

(65) Prior Publication Data

US 2017/0329250 A1 Nov. 16, 2017

(30) Foreign Application Priority Data

May 12, 2016 (JP) ..... 2016-096156

(51) Int. Cl.
*G03G 15/01* (2006.01)

(52) U.S. Cl.
CPC ..... *G03G 15/0131* (2013.01)

(58) Field of Classification Search
CPC ..... G03G 15/0131
See application file for complete search history.

(56) References Cited

U.S. PATENT DOCUMENTS

2012/0006215 A1* 1/2012 DeJong ..... G03G 15/1615 101/481

FOREIGN PATENT DOCUMENTS

JP H03288167 A 12/1991

* cited by examiner

*Primary Examiner* — Clayton E Laballe
*Assistant Examiner* — Jas Sanghera
(74) *Attorney, Agent, or Firm* — Rossi, Kimms & McDowell LLP

(57) ABSTRACT

An image forming apparatus transfers toner images of respective colors, formed on photosensitive drums, onto an intermediate transfer belt conveyed in a predetermined direction to thereby form a color toner image. A steering roller tilts the intermediate transfer belt in a direction orthogonal to the conveying direction. A first sensor detects a position of a belt lateral end of the belt, and when controlling driving of the steering roller based on a detection result of the first sensor, a controller performs predetermined filtering on the detection result, to thereby control the driving of the steering roller according to the detection result subjected to the predetermined filtering.

9 Claims, 21 Drawing Sheets

IMAGE FORMING APPARATUS THAT CONTROLS POSTURE OF INTERMEDIATE TRANSFER MEMBER AND IMAGE FORMATION POSITION BASED ON RESULTS OF DETECTION OF PREDETERMINED PORTION OF INTERMEDIATE TRANSFER MEMBER

BACKGROUND OF THE INVENTION

Field of the Invention

The present invention relates to an image forming apparatus that controls posture of an intermediate transfer member and an image formation position based on results of detection of a predetermined portion of the intermediate transfer member.

Description of the Related Art

In general, there has been known a so-called tandem-type image forming apparatus which has a plurality of image bearing members arranged side by side along a transfer belt which is an endless belt, and performs an image forming process for forming images of respective colors in parallel so as to realize high-speed image formation. As a typical example of the above-mentioned transfer belt, there is an intermediate transfer belt used in a full-color image forming apparatus using an electrophotographic process.

Toner images of the respective colors are sequentially superimposed on a surface of the intermediate transfer belt and transferred onto a transfer material, whereby a full-color toner image is formed on the transfer material. The intermediate transfer belt is stretched and held by a plurality of rollers including a drive roller, and is driven to travel. Depending on the accuracy of an outer diameter of each roller and the accuracy of alignment between the rollers, the intermediate transfer belt of the above-mentioned type is sometimes skewed toward one of lateral ends thereof during driving thereof.

To cope with this belt skew, belt skew control is performed in which skew of the belt is controlled by detecting a positional change of e.g. a belt lateral end surface and giving a tilt to a steering roller as one of members holding the inner surface of the belt. This belt skew control has an effect of preventing the belt from being damaged due to belt skew.

Further, in a case where the image forming apparatus is of a tandem type, main causes of a color misregistration in a main scanning direction and image deformation include a change in a belt conveying direction. The change in the belt conveying direction is caused by an influence of steering control for suppressing belt skew, and sometimes increases the color misregistration. There has been proposed, in Japanese Laid-Open Patent Publication (Kokai) No. H03-288167, an apparatus that detects a position of a belt lateral end using a sensor and tilts a steering roller based on a result of the detection to thereby suppress belt skew. Further, this apparatus is configured to detect a position of the belt lateral end a plurality of times to thereby detect the change in the belt conveying direction so as to adjust image formation timing, and suppress color misregistration as well.

Japanese Laid-Open Patent Publication (Kokai) No. H03-288167 discloses a method of directly detecting the position of a belt lateral end using a plurality of sensors. Further, Japanese Laid-Open Patent Publication (Kokai) No. H03-288167 also describes a method of predicting a change in the belt conveying direction based on a change in the tilt of the steering roller, which is determined by detecting the position of the belt lateral end a plurality of times. However, although the former method of detecting the belt lateral end is high in detection accuracy, but it is high in cost due to the use of the plurality of sensors. On the other hand, the latter method is lower in cost, but it is lower in detection accuracy than the former method.

Examples of the cause of the change in the belt conveying direction other than the change in the tilt of the steering roller include an initial posture and distortion of the belt at the start of driving of the belt, and contact and separation operations of members which are brought into contact with the belt, such as an image bearing member and a transfer material.

Therefore, when a high color misregistration reduction effect is desired, the former method of detecting the belt lateral end using the plurality of sensors is used.

FIG. 20 is a diagram showing a result of detection of an edge shape (profile) of the belt lateral end by one sensor.

When an endless belt, such as an intermediate transfer belt, is made, a belt material having a width corresponding to widths of a plurality of finished products of the belt is formed, and then cut into a width of each of the finished products with a view to reducing the cost. In other words, a belt base material larger in width than a belt to be actually used is manufactured, and the belts to be actually used are obtained by cutting the belt base material. Further, to ensure the accuracy of an edge shape of the endless belt and the accuracy of evenness of a belt thickness of an edge portion, the edge portion of the belt is sometimes cut by post processing.

In any case, when cutting the belt base material, a cutting tool is relatively moved along a circumferential direction of the belt. At this time, the cutting position can be laterally displaced between a cutting start position and a cutting end position, so that this displacement sometimes produces a step at a lateral end (edge) of the belt. The cutting is performed by applying the cutting tool to a predetermined position of the belt while rotating the belt. During the cutting operation, the belt skew control is performed. Therefore, it is difficult to cause the cutting position to match between the cutting start position and the cutting end position, and as a result, waving deformation and a level difference due to cutting position displacement (step at cut position) are generated in the belt lateral end, as shown in FIG. 20.

FIG. 21 is a diagram showing a result of detection of the edge shape (profile) of the belt lateral end by a plurality of sensors.

Here, two sensors are disposed at different positions from each other in the belt conveying direction. The sensor disposed at a downstream location in the conveying direction is referred to as "the downstream sensor", and the sensor disposed at an upstream location in the conveying direction is referred to as "the upstream sensor". The two sensors each detect the same belt lateral end at different detection times spaced by a time period Th. The result of detection by the downstream sensor is indicated by a broken line, and the result of detection by the upstream sensor is indicated by a solid line.

To detect the belt conveying direction, it is necessary to eliminate an influence of a profile component of the belt lateral end. To this end, the result of detection by the upstream sensor is shifted by a time period Ts, as shown in an upper graph and a central graph of FIG. 22, whereby a difference between the result of detection by the upstream sensor and the result of detection by the downstream sensor is calculated. Ideally, it is desirable that the time period Th and the time period Ts are equal to each other. Assuming that the time period Th and the time period Ts are equal to each other, the profile component of the belt lateral end is to be completely eliminated. However, actually, it is difficult to make the time period Th and the time period Ts strictly equal to each other, as described hereinafter.

As shown in the lower graph of FIG. 22, when a difference between the results of detection by the two sensors is calculated, impulse-like noise (glitch) occurs. The glitch does not represent an actual change in the belt conveying direction, and hence if the image formation timing in the main scanning direction is adjusted based on the glitch, color misregistration is made worse.

Note that the time period Th is different depending on the variation in the distance between the two sensors due to the component accuracy, variation in the conveying speed of the intermediate transfer belt, etc. Further, the time period Ts depends on a sampling clock of the sensor.

FIG. 23 is a diagram showing a result of filtering performed for eliminating impulse-like noise (glitch).

To eliminate a periodic glitch, which is impulse-like noise, from a result of detection performed on the intermediate transfer belt, in general, filtering, such as moving average filtering or low-pass filtering, is performed. By performing filtering, color misregistration in the main scanning direction is prevented from being made worse due to glitch-caused erroneous adjustment of the image formation timing.

Although the periodic glitch can be eliminated from the result of detection on the intermediate transfer belt by the above-mentioned filtering, if the period of variation in the conveying direction of the intermediate transfer belt is close to the period of a glitch, the variation in the conveying direction is also eliminated by filtering. That is, if a period of skew control for controlling belt skew by tilting the steering roller is close to the period of a glitch, the variation in the conveying direction is also eliminated by filtering. As a result, it is difficult to adjust the image formation timing based on the variation in the conveying direction.

SUMMARY OF THE INVENTION

The present invention provides an image forming apparatus described below.

The present invention provides an image forming apparatus comprising a first image forming station configured to form a first image of a first color, a second image forming station configured to form a second image of a second color, an intermediate transfer member configured to have the first image and the second image transferred thereon, a transfer portion configured to transfer the first image and the second image transferred on the intermediate transfer member to a recording medium, a first sensor configured to detect a position of a predetermined portion of the intermediate transfer member at a first location, a second sensor configured to detect a position of the predetermined portion of the intermediate transfer member at a second location different from the first location in a direction of movement of the intermediate transfer member, a steering mechanism configured to adjust a posture of the intermediate transfer member, a first filter configured to perform smoothing processing on posture data determined based on a result of detection by the first sensor and a result of detection by the second sensor, a second filter configured to perform band stop filter processing on the result of detection by the second sensor, and a controller configured to control the steering mechanism based on a result of processing by the second filter, and control a forming position of the second image based on a result of processing by the first filter.

According to the present invention, it is possible to improve the accuracy of image formation timing adjustment by eliminating a periodic disturbance occurring at the rotation period of the intermediate transfer member, such as a glitch.

Further features of the present invention will become apparent from the following description of exemplary embodiments (with reference to the attached drawings).

BRIEF DESCRIPTION OF THE DRAWINGS

FIGS. 2A and 2B are diagrams useful in explaining tilt of a steering roller disposed in the image forming apparatus shown in FIG. 1, in which FIG. 2A shows the steering roller together with an intermediate transfer belt, and FIG. 2B shows how the steering roller is supported.

FIGS. 9A and 9B are diagrams useful in explaining the image writing timing in forming images of respective colors on the intermediate transfer belt, in which FIG. 9A shows the images of the respective colors on the intermediate transfer belt, and FIG. 9B shows a relationship between skew of the intermediate transfer belt and the images of the respective colors.

FIGS. 10A and 10B are diagrams useful in explaining detection performed by belt lateral end position detection sensors, in which FIG. 10A shows an example of the detection, and FIG. 10B shows another example of the same.

DESCRIPTION OF THE EMBODIMENTS

The present invention will now be described in detail below with reference to the accompanying drawings showing embodiments thereof.

Figure 1:
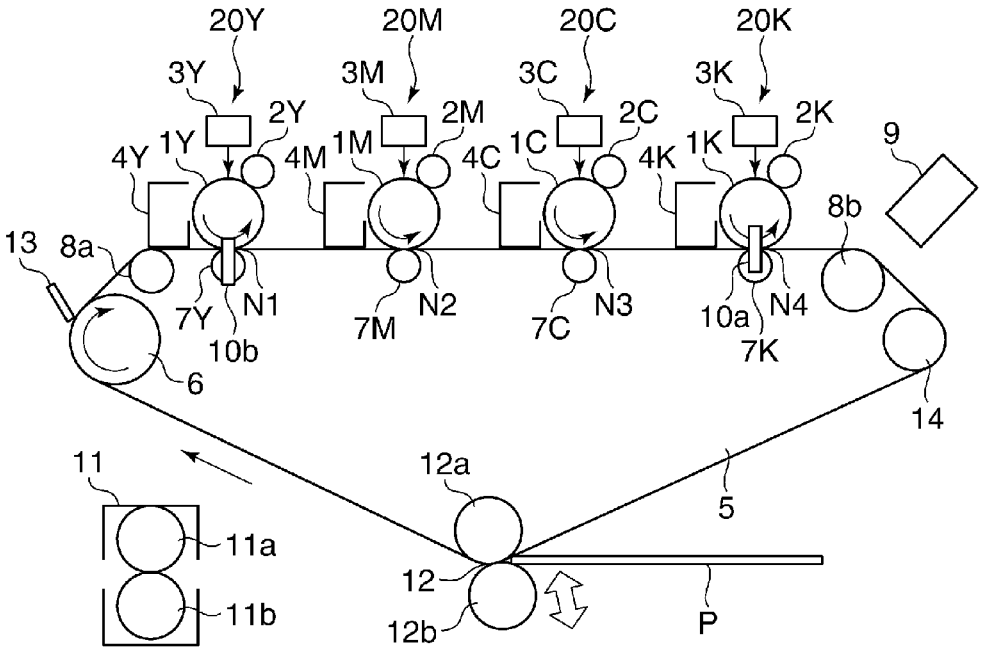
FIG. 1 is a schematic diagram of an image forming apparatus.

FIG. 1 is a schematic diagram of an image forming apparatus according to the present embodiment.

The illustrated image forming apparatus is a full-color image forming apparatus, such as a printer using an electrophotographic process. This image forming apparatus includes four image forming stations (image forming units): an image forming station 20Y, an image forming station 20M, an image forming station 20C, and an image forming station 20K. The image forming station 20Y forms an image of yellow, and the image forming station 20M forms an image of magenta. Further, the image forming station 20C forms an image of cyan, and the image forming station 20K forms an image of black. These four image forming stations are arranged along an intermediate transfer belt (intermediate transfer member) 5 with a predetermined spacing between each adjacent ones.

The image forming stations 20Y, 20M, 20C, and 20K are provided with photosensitive drums 1Y, 1M, 1C, and 1K as image bearing members, respectively. Around the photosensitive drums 1Y, 1M, 1C, and 1K, there are arranged charge rollers 2Y, 2M, 2C, and 2K, respectively. Further, around the photosensitive drums 1Y, 1M, 1C, and 1K, there are arranged developing devices 4Y, 4M, 4C, and 4K, primary transfer rollers 7Y, 7M, 7C, and 7K, and drum cleaners (not shown), respectively. Further, exposure devices 3Y, 3M, 3C, and 3K are arranged at respective locations upward of spaces between the charge rollers 2Y, 2M, 2C, and 2K and the developing devices 4Y, 4M, 4C, and 4K, respectively.

The photosensitive drums 1Y, 1M, 1C, and 1K are driven for rotation by a drive unit (not shown) at a predetermined circumferential speed in a direction indicated by a solid arrow (anticlockwise direction). The charge rollers 2Y, 2M, 2C, and 2K are brought into contact with the photosensitive drums 1Y, 1M, 1C, and 1K with a predetermined pressure contact force, respectively. The charge rollers 2Y, 2M, 2C, and 2K uniformly charge surfaces of the photosensitive drums 1Y, 1M, 1C, and 1K to a predetermined potential with a charging bias applied from a charging bias power supply (not shown), respectively.

The exposure devices 3Y, 3M, 3C, and 3K expose the surfaces of the photosensitive drums 1Y, 1M, 1C, and 1K with light modulated based on time-series electric digital pixel signals of image information (image data) input from a host computer (not shown), respectively. As a result, electrostatic latent images corresponding to the image information are formed on the surfaces of the photosensitive drums 1Y, 1M, 1C, and 1K.

The developing devices 4Y, 4M, 4C, and 4K attach toner to the electrostatic latent images formed on the photosensitive drums 1Y, 1M, 1C, and 1K, each with a developing bias applied from a developing bias power supply (not shown), respectively. As a result, the electrostatic latent images formed on the photosensitive drums 1Y, 1M, 1C, and 1K are developed (reversal development) as toner images. Note that the developing devices 4Y, 4M, 4C, and 4K store yellow toner, cyan toner, magenta toner, and black toner, respectively.

The primary transfer rollers 7Y, 7M, 7C, and 7K each include an electrode so as to uniformly apply a voltage along a longitudinal direction thereof. Further, the primary transfer rollers 7Y, 7M, 7C, and 7K are brought into contact with the photosensitive drums 1Y, 1M, 1C, and 1K via the endless intermediate transfer belt 5 at transfer portions N1, N2, N3, and N4, respectively.

The intermediate transfer belt 5 is stretched and held by a drive roller 6, a plurality of driven rollers 8*a* and 8*b*, and so forth, and is driven for rotation by driving the drive roller 6 for rotation in a direction indicated by a solid arrow. Rotational driving of the photosensitive drums 1Y, 1M, 1C, and 1K and the drive roller 6 is controlled by a controller (CPU). A belt image position detection section (also referred to as the registration patch detection sensor) 9 is disposed in a manner opposed to the driven roller 8*b*. The belt image position detection section 9 detects a position of an image (toner image) transferred onto the intermediate transfer belt 5.

Belt lateral end position detection sensors 10*a* and 10*b* are disposed at the image forming station 20K and the image forming station 20Y, respectively. The position of a lateral end of the intermediate transfer belt 5 is detected by the belt lateral end position detection sensor 10*a* a plurality of times to thereby detect skew (change in the position) of the intermediate transfer belt 5. Then, a steering roller 14 as one of members holding the inner surface of the intermediate transfer belt 5 is tilted to thereby suppress skew of the intermediate transfer belt 5.

Figure 2A:
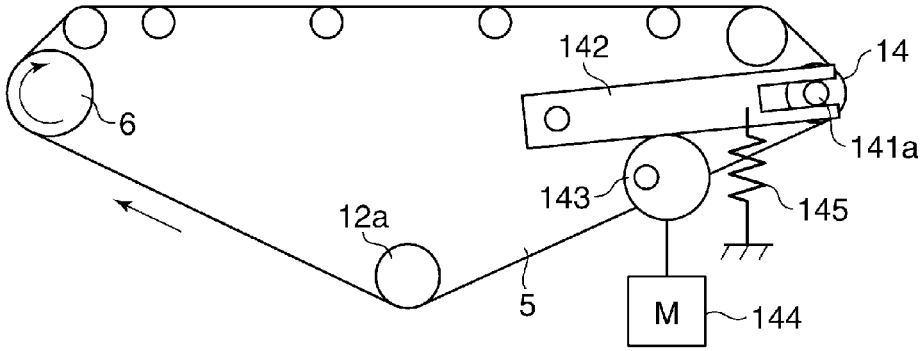
Figure 2B:
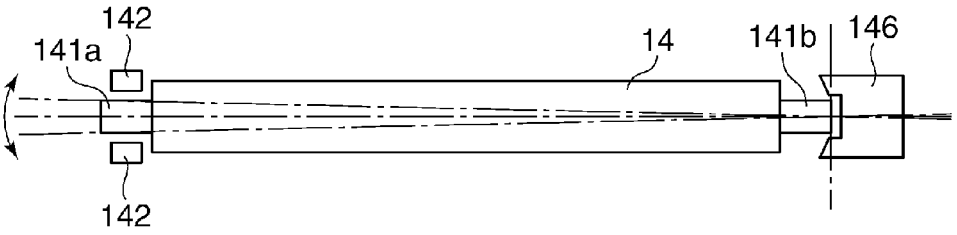

FIGS. 2A and 2B are diagrams useful in explaining tilt of the steering roller 14 provided in the image forming apparatus shown in FIG. 1, in which FIG. 2A shows the steering roller 14 together with the intermediate transfer belt 5, and FIG. 2B shows how the steering roller 14 is supported.

A steering roller actuator 144 is operated based on a result of detection by the belt lateral end position detection sensor 10*a*. A steering cam 143 is connected to the steering roller actuator 144, and the center of rotation of the steering cam 143 is in an eccentric position. The steering cam 143 is rotated by a driving force applied from the steering roller actuator 144.

A steering arm 142 urged by an elastic member 145 is in contact with an outer periphery of the steering cam 143. One end of the steering arm 142 is rotatably supported, and the other end of the same is fitted on a steering roller shaft portion 141*a* in the center of the steering roller 14.

A steering roller shaft portion 141*b* is supported by a steering roller bearing 146, whereby the steering roller 14 is rotatably and tiltably held. Further, the operation of the steering roller actuator 144 is converted to an operation for tilting the steering roller 14.

Figure 3:
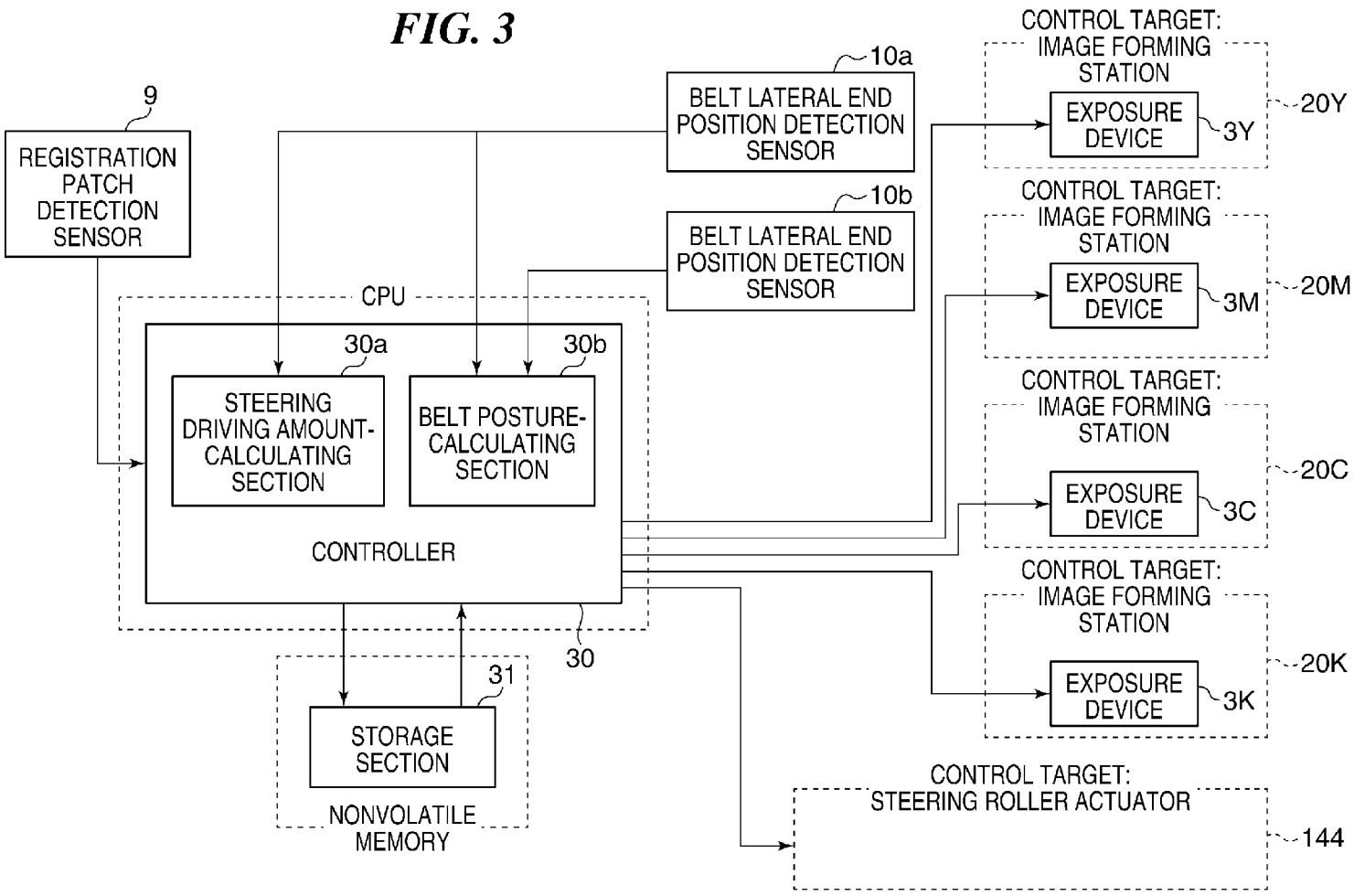
FIG. 3 is a block diagram of a control system of the image forming apparatus.

FIG. 3 is a block diagram of a control system of the image forming apparatus shown in FIG. 1. The same component elements in FIG. 3 as those in FIGS. 1, 2A, and 2B are denoted by the same reference numerals.

The controller (CPU), denoted by reference numeral 30, includes a steering driving amount-calculating section 30*a* and a belt posture-calculating section 30*b*, and a result of detection (detection output) by the registration patch detection sensor 9 is input to the controller 30. Further, a storage section 31 is connected to the controller 30.

A result of detection by the belt lateral end position detection sensor 10*a* is input to the steering driving amount-calculating section 30*a*, and the steering driving amount-calculating section 30*a* calculates a steering driving amount, as described hereinafter. Further, results of detection by the belt lateral end position detection sensors 10*a* and 10*b* are input to the belt posture-calculating section 30*b*, and the belt posture-calculating section 30*b* determines a belt posture, as described hereinafter. As described hereinabove, the controller 30 controls the exposure devices 3Y, 3M, 3C, and 3K, and further controls driving of the steering roller actuator 144. Further, the controller 30 controls other components, not shown in FIG. 3.

Figure 4:
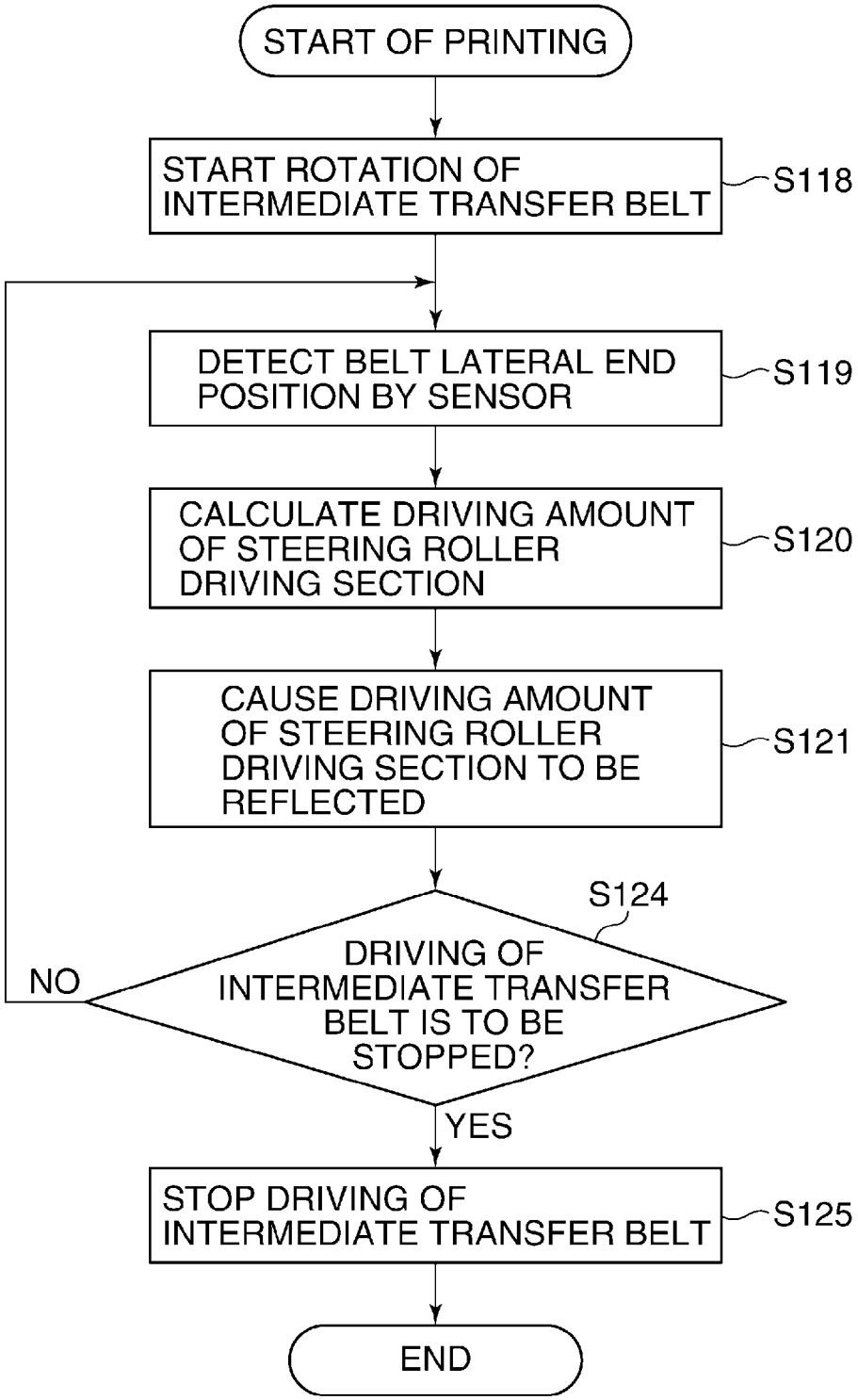
FIG. 4 is a flowchart of a transfer belt-driving process performed by the image forming apparatus.

FIG. 4 is a flowchart of a transfer belt-driving process performed during a printing operation of the image forming apparatus shown in FIG. 1.

The image forming apparatus starts printing in response to a user's instruction. When printing is started, the controller 30 causes the intermediate transfer belt 5 to rotate (step S118). The belt lateral end position detection sensor 10*a* detects the intermediate transfer belt lateral end being rotated (step S119). The steering driving amount-calculating section 30*a* of the controller 30 calculates a steering roller-driving amount based on a result of the detection by the belt lateral end position detection sensor 10*a* (step S120). Then, the controller 30 controls the driving of the steering roller actuator 144 according to the calculated steering roller-driving amount so as to tilt the steering roller 14 (step S121).

When the steering roller 14 is tilted, the intermediate transfer belt 5 is moved in the width direction. The skew control of the intermediate transfer belt 5 is performed, and then, the controller 30 determines whether or not to stop the driving of the intermediate transfer belt 5 (step S124). If the driving of the intermediate transfer belt 5 is to be continued (NO to the step S124), the controller 30 repeats the steps S119 to S124.

On the other hand, if the driving of the intermediate transfer belt 5 is to be stopped (YES to the step S124), the controller 30 stops the driving of the intermediate transfer belt 5 (step S125).

As described hereinabove, not only the belt lateral end position detection sensor 10*a*, but also the belt lateral end position detection sensor 10*b* is disposed. The controller 30 determines the conveying direction of the intermediate transfer belt 5 (also referred to as the belt posture) based on the results of detection by the belt lateral end position detection sensor 10*a* and the belt lateral end position detection sensor 10*b*.

Here, a description will be given of an image forming operation performed by the image forming apparatus shown in FIG. 1.

Upon receipt of an image forming operation start signal, the controller 30 causes the photosensitive drums 1Y, 1M, 1C, and 1K to rotate at a predetermined processing speed. Then, the charge rollers 2Y, 2M, 2C, and 2K uniformly charge the photosensitive drums 1Y, 1M, 1C, and 1K, respectively. Then, the exposure devices 3Y, 3M, 3C, and 3K perform exposure scanning on the photosensitive drums 1Y, 1M, 1C, and 1K according to color image signals. As a result, electrostatic latent images are formed on the photosensitive drums 1Y, 1M, 1C, and 1K.

Then, the developing device 4Y develops the electrostatic latent image formed on the photosensitive drum 1Y with toner to thereby form a Y toner image. The Y toner image on the photosensitive drum 1Y is transferred onto the intermediate transfer belt 5 by the primary transfer roller 7Y to which the transfer bias (having a reverse polarity to the polarity of toner) is applied at the primary transfer portion N1. At this time, the primary transfer roller 7Y is pressed by the photosensitive drum 1Y with a predetermined pressure force via the intermediate transfer belt 5.

The Y toner image formed on the intermediate transfer belt 5 rotated by the drive roller 6 is conveyed to the image forming station 20M. Then, an M toner image formed on the photosensitive drum 1M is transferred onto the intermediate transfer belt 5 in a manner superimposed on the Y toner image at the primary transfer portion N2.

After that, a C toner image and a K toner image are sequentially similarly transferred at the primary transfer portions N3 and N4, respectively. The Y, M, C, and K toner images are thus transferred in superimposed relation, whereby a full-color toner image is formed on the intermediate transfer belt 5. In short, the toner images are sequentially transferred onto the intermediate transfer belt 5 to thereby form a full-color image.

The full-color toner image formed on the intermediate transfer belt 5 is transferred onto a transfer material P at a secondary transfer portion 12. Then, the transfer material P is conveyed to a fixing device 11. The fixing device 11 applies heat and pressure to the full-color toner image on the transfer material P at a fixing nipping portion formed by a fixing roller 11*a* and a pressure roller 11*b* to thereby fix the image to the transfer material P. After that, the transfer material P output from the fixing device 11 is discharged to the outside of the image forming apparatus.

Note that at the secondary transfer portion 12, the intermediate transfer belt 5 is sandwiched and held by a secondary inner roller 12*a* and a secondary outer roller 12*b*. Further, transfer residual toner remaining on the photosensitive drums 1Y, 1M, 1C, and 1K is eliminated and collected by the drum cleaners (not shown). Further, residual toner remaining on the intermediate transfer belt 5 is eliminated and collected by a cleaning blade 13.

Next, a description will be given of an image writing correction mode (color registration adjustment) of the image forming apparatus shown in FIG. 1. Note that color registration adjustment is performed as the base of image formation timing adjustment.

When performing color registration adjustment, test images (registration patches) are formed on the photosensitive drums, and the test images (registration patches) are transferred onto the intermediate transfer belt 5. Then, the respective positions of the registration patches on the intermediate transfer belt 5 are detected by the registration patch detection sensor 9. The controller 30 corrects the image writing position with respect to the photosensitive drums based on a result of detection by the registration patch detection sensor 9.

Figure 5:
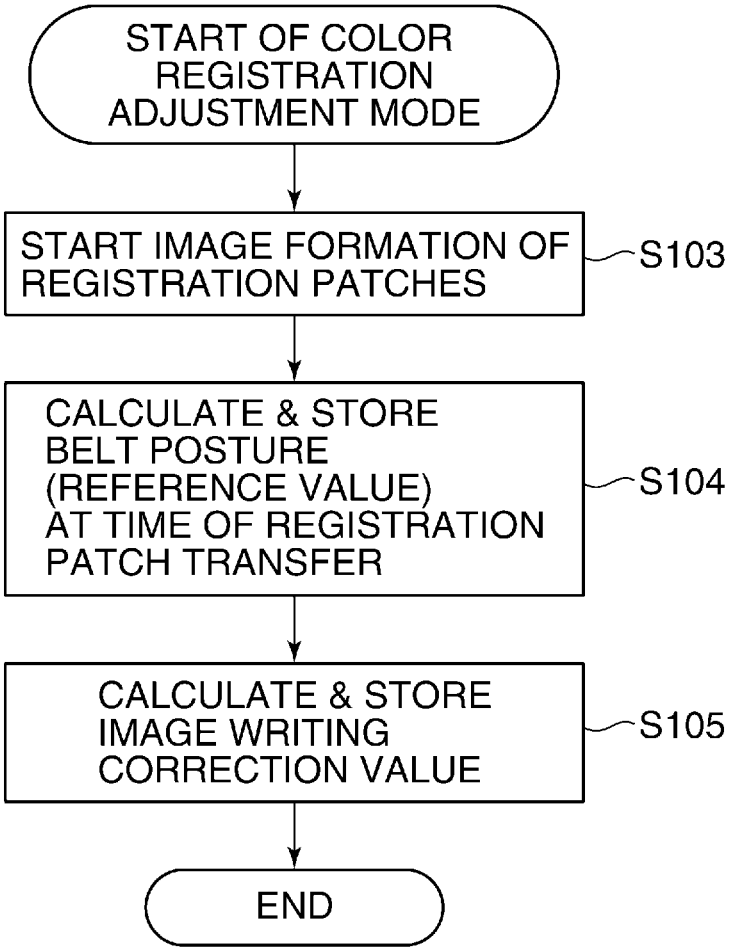
FIG. 5 is a flowchart of a color registration adjustment process performed by the image forming apparatus.

FIG. 5 is a flowchart of a color registration adjustment process performed by the image forming apparatus shown in FIG. 1.

The controller 30 starts the color registration adjustment mode in response to a user's instruction. Note that the controller 30 executes the color registration adjustment mode at a predetermined timing as well, such as when the image forming apparatus is started or whenever the number of printed sheets reaches a predetermined value.

In the color registration adjustment mode, an image writing position misalignment due to manufacturing variations of the image forming apparatus, and temporal changes in image writing position caused e.g. by an increase in temperature within the apparatus are corrected. Further, in the color registration adjustment mode, detection of a reference posture of the intermediate transfer belt, which is used for image formation timing adjustment for correcting color misregistration caused by an improper belt posture in the image forming operation, described hereinafter, is performed at the same time.

Upon receipt of a color registration adjustment mode start instruction, the controller 30 starts to form images of registration patches as test images using the image forming stations 20Y, 20M, 20C, and 20K (step S103).

Figure 6:
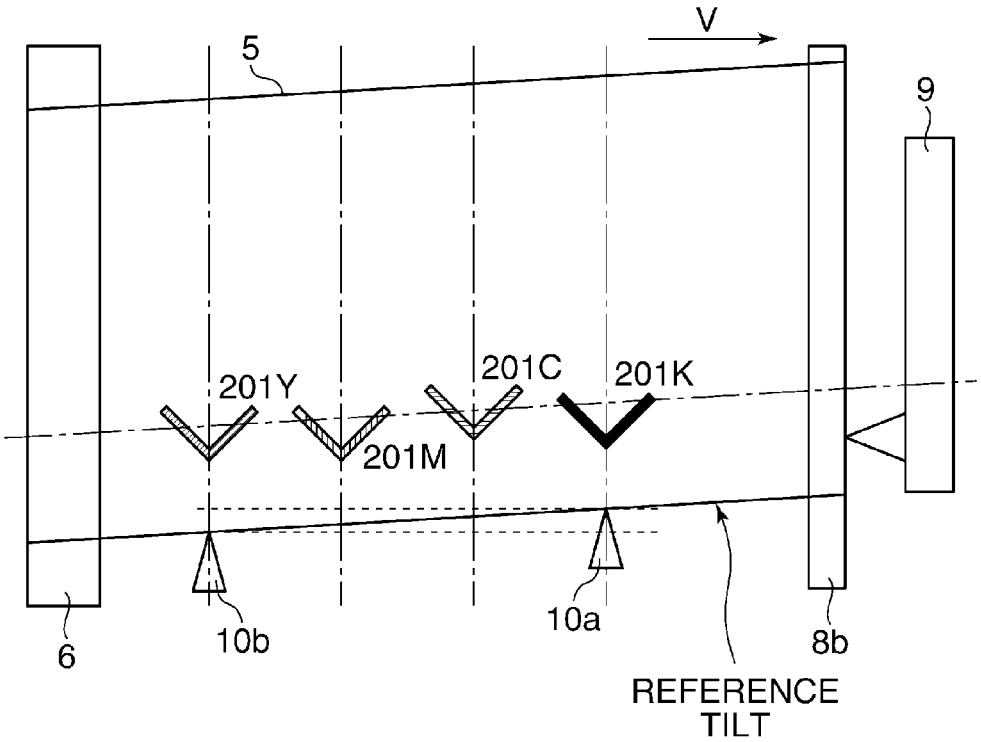
FIG. 6 is a diagram illustrating a belt conveying direction (belt posture) in the image forming apparatus.

FIG. 6 is a diagram illustrating an example of a belt conveying direction (belt posture) of the image forming apparatus shown in FIG. 1.

The belt posture-calculating section 30*b* determines a belt conveying direction (belt posture) according to results of detection by the belt lateral end position detection sensors 10*a* and 10*b*, and stores the determined belt posture in the storage section 31 as a reference value (posture reference value) (step S104). Here, as shown in FIG. 6, the belt posture-calculating section 30*b* determines the belt posture based on the results of detection by the belt lateral end position detection sensors 10*a* and 10*b* of the registration patches at the time of the registration patch transfer at the primary transfer portions N1 to N4. Then, the controller 30 sets the obtained belt posture as a reference tilt.

Figure 7:
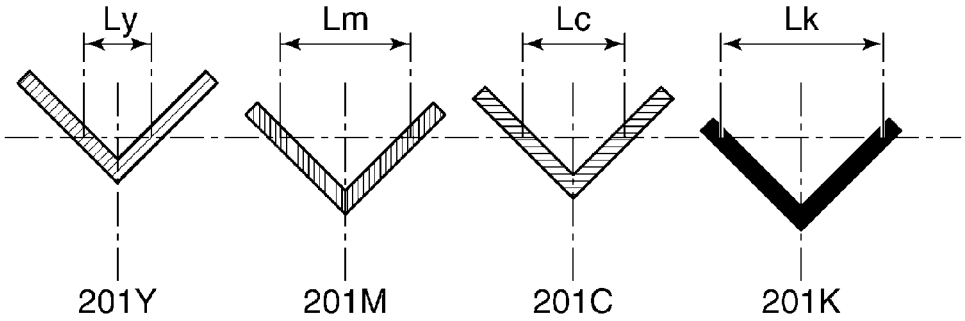
FIG. 7 is a diagram showing an example of registration patches formed by the image forming apparatus.

FIG. 7 is a diagram showing an example of the registration patches formed by the image forming apparatus shown in FIG. 1.

As shown in FIG. 7, a Y registration patch 201Y, an M registration patch 201M, a C registration patch 201C, and a K registration patch 201K are formed on the intermediate transfer belt 5 at predetermined intervals as the registration patches. Then, the controller 30 detects the registration patches on the intermediate transfer belt 5 using the registration patch detection sensor 9. The controller 30 uses a time at which the Y registration patch 201Y is detected as a reference, and obtains a positional relationship between the respective registration patches relative to each other according to times at which the M registration patch 201M, the C registration patch 201C, and the K registration patch 201K are detected, respectively.

For example, when the registration patches 201Y and 201M pass the registration patch detection sensor 9, passing time periods Ly and Lm, indicated in FIG. 7, represent positions in a main scanning direction (direction orthogonal to the belt conveying direction), respectively. The controller 30 calculates correction values of M, C, and K such that the positions of the toner images of the other colors (M, C, and K) than the color Y are caused to coincide with the position of the toner image Y, based on the relative positional relationship between the registration patches, and stores the calculated correction value (image writing correction value) in the storage section 31 (step S105). Then, the controller 30 terminates the color registration adjustment mode. Here, the image writing correction value and the belt posture will be further described.

Referring to FIG. 6, the time periods measured when the registration patches 201Y, 201M, 201C, and 201K pass the registration patch detection sensor 9 are represented by Ly, Lm, Lc, and Lk. In this case, misregistration of each of the registration patches in the main scanning direction with respect to the disposed position of the registration patch detection sensor 9 is equal to Ly/2, Lm/2, Lc/2, and Lk/2, respectively. Note that it is assumed, as a precondition, that an angle of each registration patch with respect to the conveying direction of the intermediate transfer belt 5 is set to 45°.

Here, the reference color used in correcting the misregistration between the registration patches relative to one other is set to Y, and the main scanning direction in which the exposure devices scan is a direction orthogonal to the conveying direction of the intermediate transfer belt 5. To correct the misregistration of M with respect to the reference color Y, the image writing timing is delayed by a time period expressed by $|Ly/2-Lm/2|$.

To correct the misregistration of C with respect to the reference color Y, it is only required to advance the image writing timing by a time period represented by $|Ly/2-Lc/2|$. By thus changing the image writing timing, the relative misregistration is corrected.

In color registration adjustment, the posture of the intermediate transfer belt 5 is detected by the belt lateral end position detection sensors 10*a* and 10*b* over a time period from when registration patches are transferred at the primary transfer portions until when the registration patches pass the registration patch detection sensor 9. Then, results of the detection by the belt lateral end position detection sensors 10*a* and 10*b* are averaged at a predetermined time to thereby determine the intermediate transfer belt posture (BS).

The belt posture of each color is defined as a posture determined based on a ratio of "a distance between the reference color Y and a color to be corrected" to "a sensor-to-sensor distance between the two belt lateral end position detection sensors 10*a* and 10*b*". For example, assuming that the sensor-to-sensor distance is represented by D, a distance between Y (reference color) and M is represented by D/3, a distance between Y and C is represented by 2D/3, a distance between Y and K is represented by 3D/3, and the posture of the intermediate transfer belt 5 is represented by BS. In this case, a reference posture BSm of M, a reference posture BSc of C, and a reference posture BSk of K, used in color registration adjustment, are expressed by the following equations (1) to (3), respectively:

$$BSm=BS\times 1/3 \quad (1)$$

$$BSc=BS\times 2/3 \quad (2)$$

$$BSk=BS\times 3/3 \quad (3)$$

In the color registration adjustment mode, finally, "an image writing correction value for each color and a belt reference posture determined when correction of the color is determined" are stored in the storage section 31 in association with each other.

Then, a description will be given of image writing timing adjustment in printing (image formation) performed by the image forming apparatus shown in FIG. 1.

Figure 8:
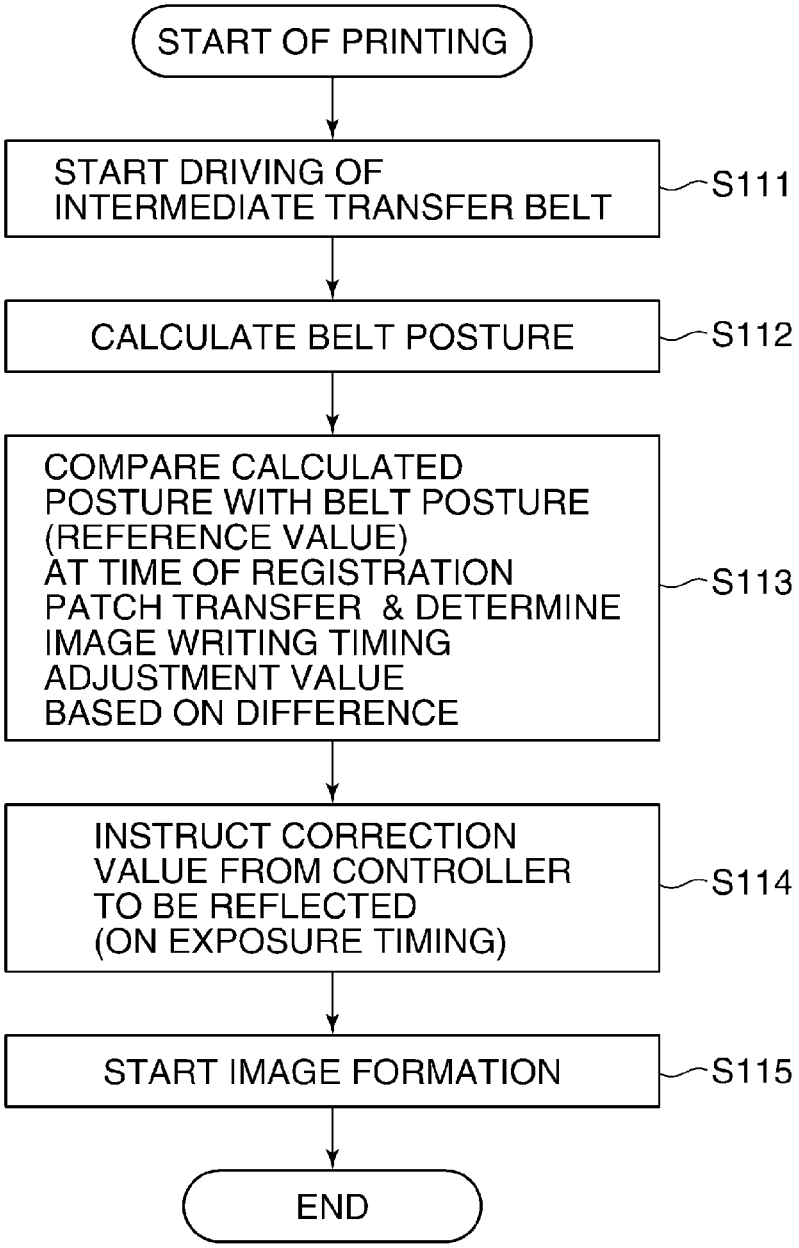
FIG. 8 is a flowchart of a process for adjusting image writing timing in printing performed by the image forming apparatus.

FIG. 8 is a flowchart of a process for adjusting image writing timing in printing performed by the image forming apparatus shown in FIG. 1.

When a printing operation is started in response to a user's instruction, the controller 30 starts driving of the intermediate transfer belt 5 (step S111). Then, the belt posture-calculating section 30*b* determines the posture of the intermediate transfer belt 5 (belt posture) based on results of detection by the belt lateral end position detection sensors 10*a* and 10*b* (step S112).

Next, the controller 30 compares the determined belt posture and the belt posture (reference value) determined in the color registration adjustment to thereby determine a difference. The controller 30 adds an amount of change of the current belt posture to the image writing correction value determined in the color registration adjustment. Then, the controller 30 determines a result of the addition as a final image writing timing adjustment value (step S113). The controller 30 changes the exposure timing according to this adjustment value, and causes the exposure timing to be reflected on an image writing start position (step S114).

Figure 9A:
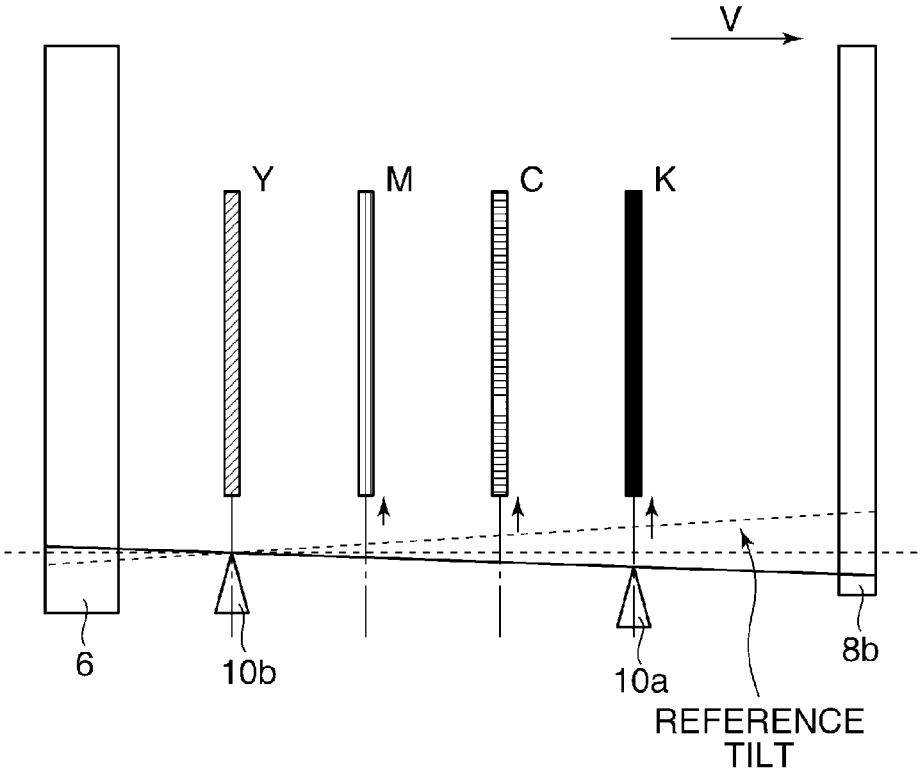
Figure 9B:
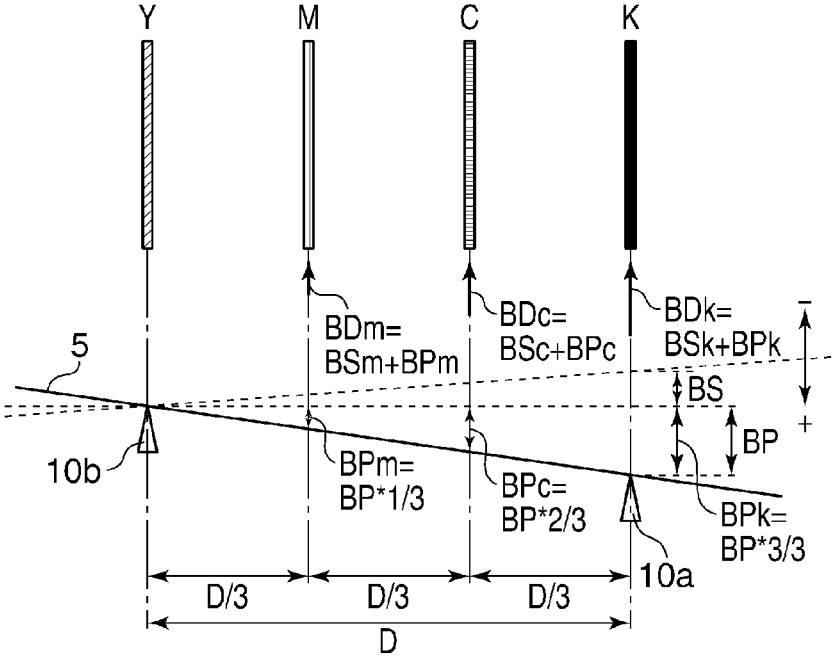

FIGS. 9A and 9B are diagrams useful in explaining the image writing timing in forming images of the respective colors on the intermediate transfer belt, in which FIG. 9A shows the images of the respective colors on the intermediate transfer belt, and FIG. 9B shows a relationship between skew of the intermediate transfer belt and the images of the respective colors.

When determining the belt posture, the results of detection by the belt lateral end position detection sensors 10*a* and 10*b* are averaged at a predetermined time immediately before image formation, and the calculated value is set as the belt posture (BP). By using the thus calculated belt posture, the current belt postures BPm, BPc, and BPk for the respective colors are expressed by the following equations (4) to (6):

$$BPm=BP\times 1/3 \quad (4)$$

$$BPc=BP\times 2/3 \quad (5)$$

$$BPk=BP\times 3/3 \quad (6)$$

When the belt postures BSm, BSc, and BSk for the respective colors determined in the color registration adjustment are used as the reference, the belt postures BDm, BDc, and BDk for the respective colors with respect to the belt postures determined in the color registration adjustment are expressed by the following equations (7) to (9):

$$BDm=BSm+BPm \quad (7)$$

$$BDc=BSc+BPc \quad (8)$$

$$BDk=BSk+BPk \quad (9)$$

Then, the controller 30 causes the belt postures BDm, BDc, and BDk for the respective colors to be reflected on the exposure timing. In the illustrated example, the start times of writing the M, C, and K images are shifted from that of the Y image by BDm, BDc, and BDk, respectively, to thereby reduce the misregistration of the respective colors from the reference color Y.

Figure 10A:
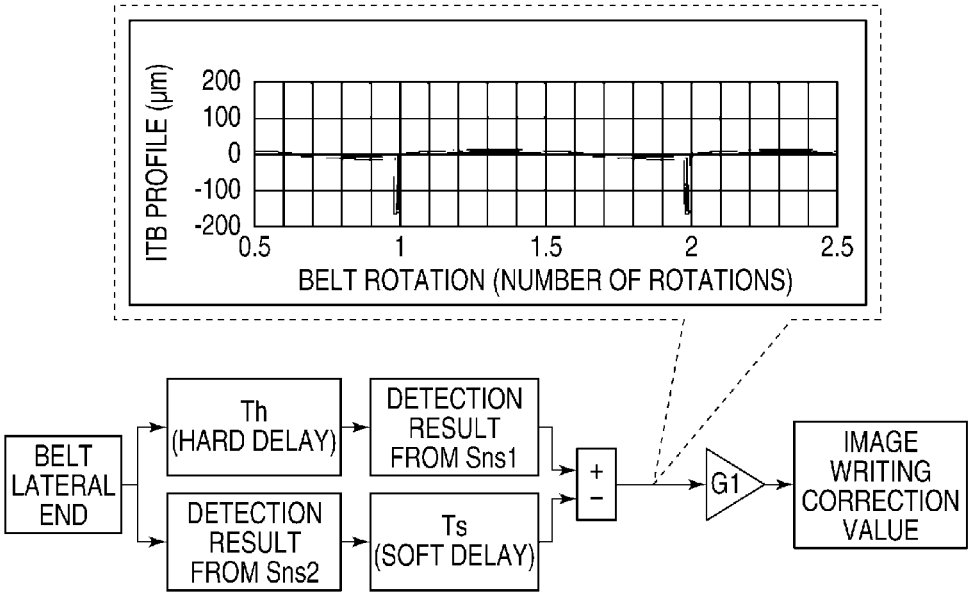
Figure 10B:
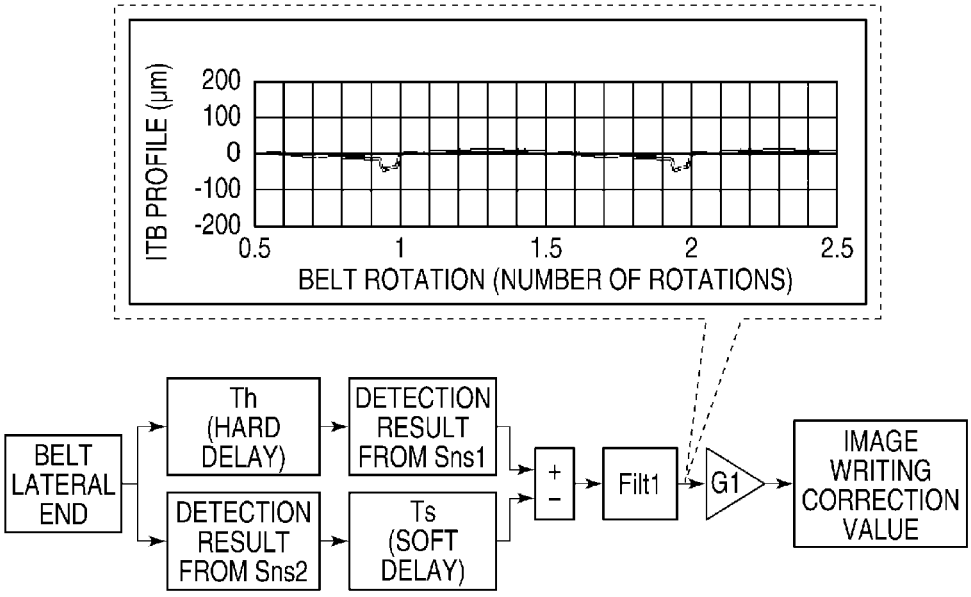

FIGS. 10A and 10B are diagrams useful in explaining detection performed by the belt lateral end position detection sensors 10*a* and 10*b* appearing in FIG. 1. FIG. 10A shows a comparative example. Note that in FIGS. 10A and 10B, the belt lateral end position detection sensors 10*a* and 10*b* are represented by Sns1 and Sns2, respectively. As mentioned hereinabove, the belt lateral end is not formed into an ideal straight line, but has waving deformation and a level difference due to cutting position displacement (step at cut position), which are generated in the manufacturing process. The sensor Sns2 disposed on an upstream side in the belt conveying direction first detects the belt lateral end, and the controller 30 stores a result of the detection in the storage section 31. Then, the sensor Sns1 disposed on a downstream side detects the same belt lateral end after the lapse of the time period Th.

To eliminate adverse influence of the waving deformation and the level difference at the belt lateral end due to cutting position displacement (step at cut position), the controller 30 subtracts the result of detection by the sensor Sns2 the time period Ts earlier, from the result of detection by the sensor Sns1. As mentioned hereinabove, the time period Th varies e.g. due to the component accuracy and variation in the conveying speed of the intermediate transfer belt. Further, the time period Ts depends on the sampling clock. Therefore, it is difficult to make the time period Th and the time period Ts strictly equal to each other. Therefore, the difference calculated by the subtraction has impulse-like noise (glitch).

To cope with this, in the present embodiment, filter (Filt 1) processing for reducing impulse-like noise is performed on the calculated difference, as shown in FIG. 10B. This smoothes the glitch which is periodically generated. In the present embodiment, a smoothing filter is used as the filter (Filt 1). Note that any other filter, such as a moving average filter, may be used insofar as it can reduce impulse-like noise.

After that, the calculated difference subjected to the filter processing is corrected with a predetermined gain (G1) to generate an image writing correction value.

On the other hand, a result of belt lateral end detection by the belt lateral end position detection sensor 10*a* (Sns1) is used for belt skew control. This is because the belt lateral end position detection sensor 10*a* (Sns1) is closer to the steering roller 14 than the belt lateral end position detection sensor 10*b* (Sns2). The controller 30 causes the steering driving amount-calculating section 30*a* to calculate a driving amount (controlled variable) of the steering roller 14 based on the result of detection by the sensor Sns1.

Here, a description will be given of the skew control based a case where a period of belt skew is ten times the rotation period of the intermediate transfer belt, by way of example.

Figure 11:
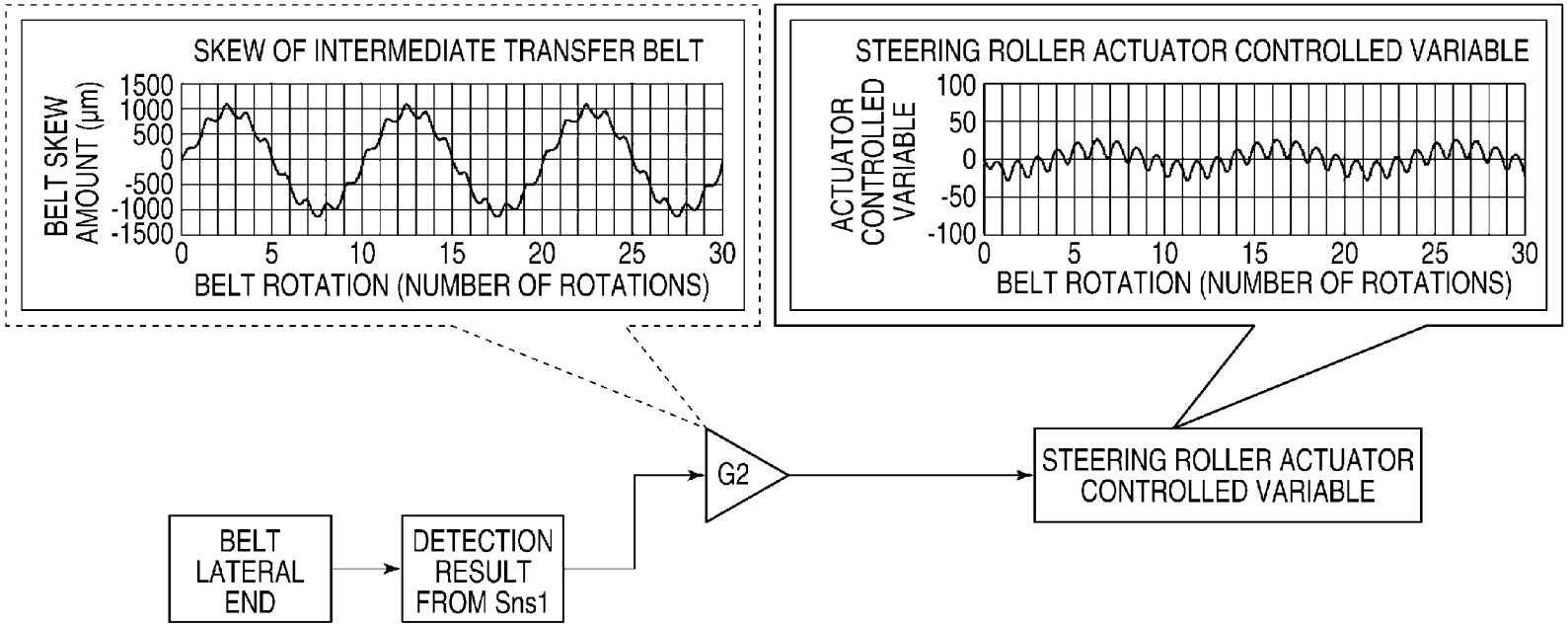
FIG. 11 is a diagram useful in explaining a first example of a driving amount calculated by a steering driving amount-calculating section appearing in FIG. 3.

FIG. 11 is a diagram useful in explaining a first example (first comparative example) of the driving amount calculated by the steering driving amount-calculating section appearing in FIG. 3. This example shows a case where belt skew occurs at a period which is ten times the rotation period of the intermediate transfer belt 5.

Here, the belt lateral end is detected by the belt lateral end position detection sensor 10*a* (Sns1) appearing in FIG. 3, and the controlled variable (driving amount) of the steering roller actuator 144 that tilts the steering roller 14 is determined based on a result of the detection. More specifically, the steering driving amount-calculating section 30*a* determines the controlled variable (driving amount) of the steering roller actuator 144 by multiplying the amount of belt skew, which is calculated based on the result of the detection of the belt lateral end by the belt lateral end position detection sensor 10*a* (Sns1), by a predetermined gain (G2). The controller 30 performs the skew control by controlling driving of the steering roller actuator 144 which is a control target, based on the calculated controlled variable.

Figure 12:
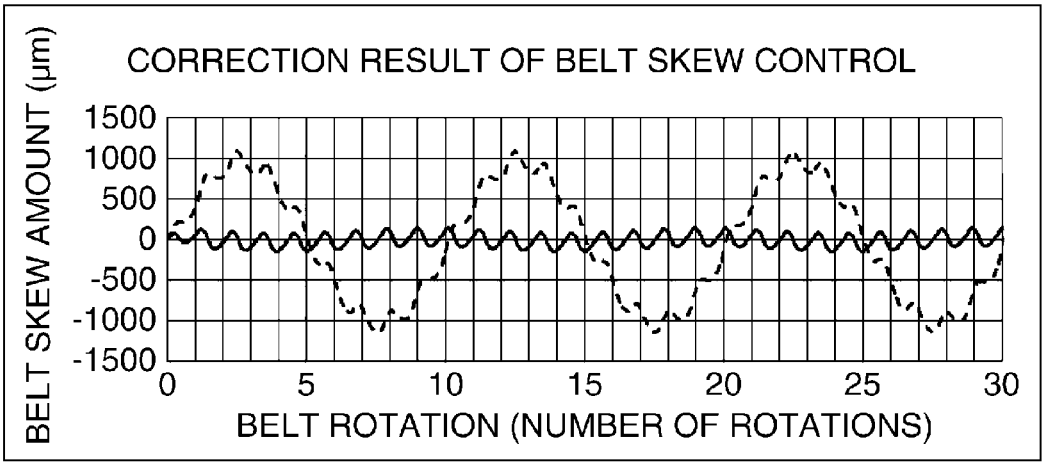
FIG. 12 is a diagram showing changes in belt lateral end position occurring when skew control described with reference to FIG. 11 is performed.

FIG. 12 is a diagram showing variations in the belt lateral end position detected when the skew control described with reference to FIG. 11 is performed. Referring to FIG. 12, a broken line indicates variations in the belt lateral end position in a case where the skew control is not performed, and a solid line indicates variations in the belt lateral end position in a case where the skew control is performed. As shown in FIG. 12, when the skew control described with reference to FIG. 11 is performed, variations in the belt lateral end position can be suppressed.

Figure 13:
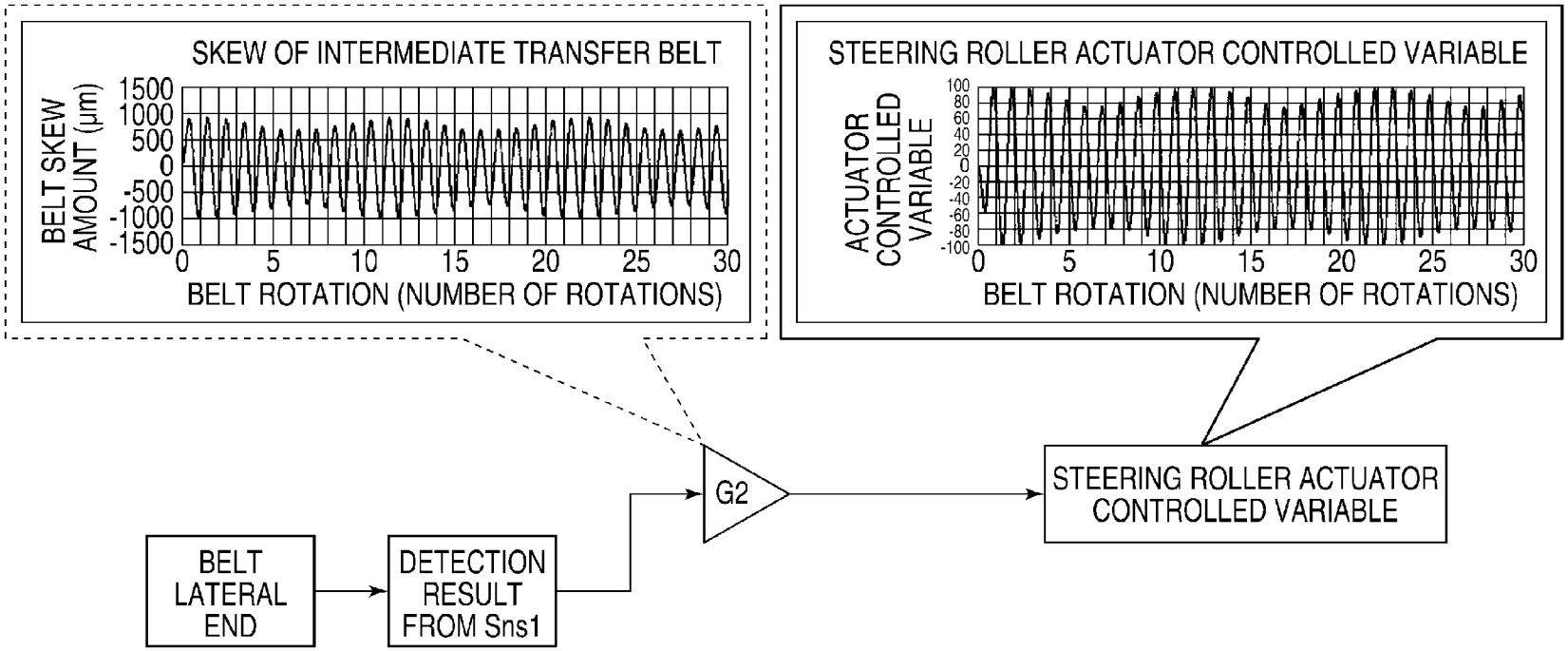
FIG. 13 is a diagram useful in explaining a second example of the driving amount calculated by the steering driving amount-calculating section.

FIG. 13 is a diagram useful in explaining a second example (second comparative example) of the driving amount calculated by the steering driving amount-calculating section 30*a* appearing in FIG. 3. This example shows a case where the period of belt skew is one time the rotation period of the intermediate transfer belt 5.

In the second comparative example as well, similar to the first comparative example, the steering driving amount-calculating section 30*a* calculates the controlled variable by multiplying the belt skew amount calculated based on the result of the detection of the belt lateral end by the belt lateral end position detection sensor 10*a* (Sns1) by the predetermined gain (G2). The controller 30 performs the skew control by controlling driving of the steering roller actuator 144, based on the controlled variable.

Figure 14:
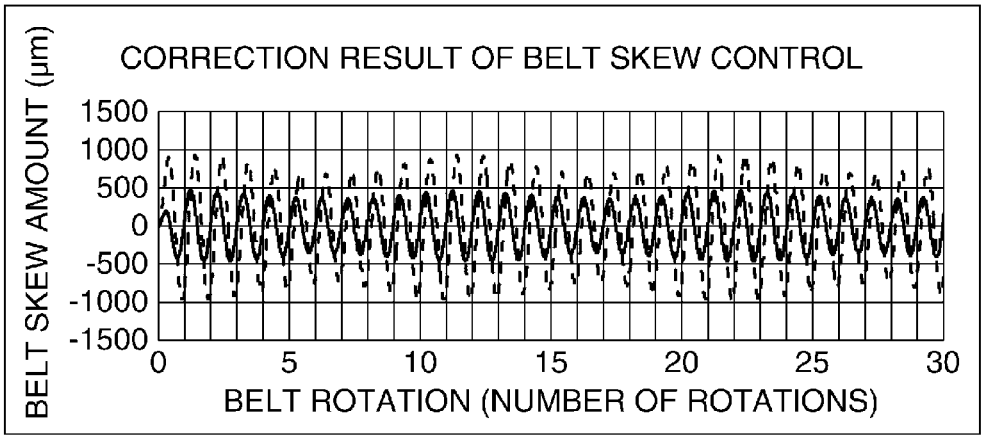
FIG. 14 is a diagram showing variations in the belt lateral end position occurring when skew control described with reference to FIG. 13 is performed.

FIG. 14 is a diagram showing variations in the belt lateral end position detected when the skew control described with reference to FIG. 13 is performed.

Referring to FIG. 14, a broken line indicates variations in the belt lateral end position in a case where the skew control is not performed, and a solid line indicates variations in the belt lateral end position in a case where the skew control is performed. As is apparent from FIG. 14, by performing the skew control described with reference to FIG. 13, it is possible to suppress variations in the belt lateral end position to some extent.

Figure 20:
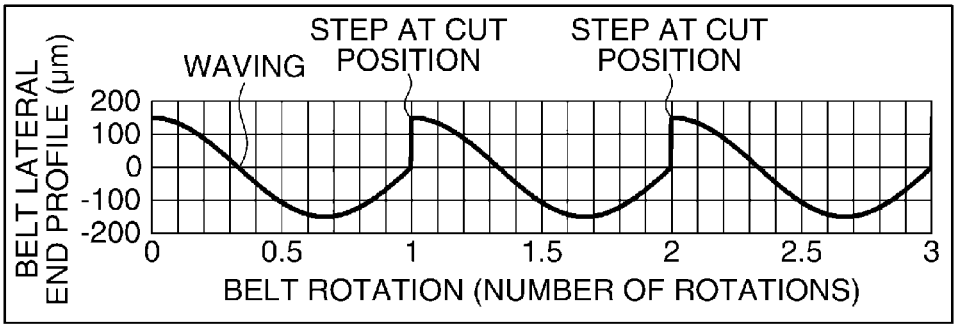
FIG. 20 RELATED ART
FIG. 20 is a diagram showing an example of a result of detection when an edge shape (profile) of the belt lateral end is detected by one sensor.
Figure 21:
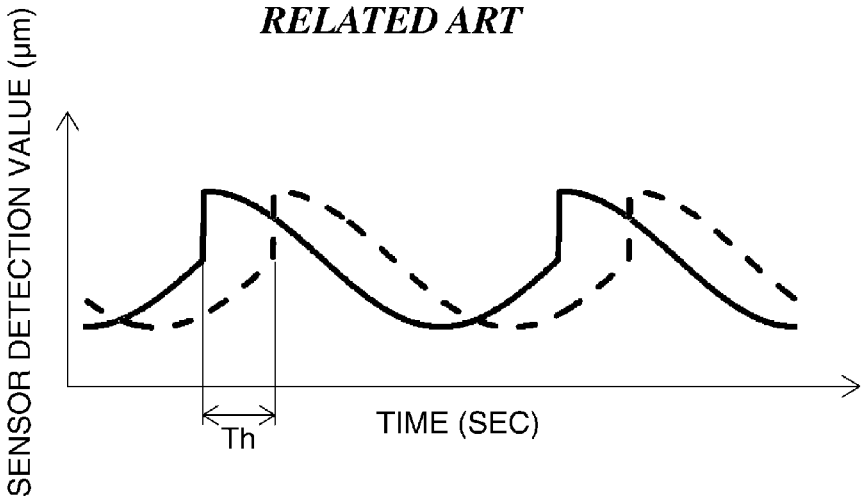
FIG. 21 RELATED ART
FIG. 21 is a diagram showing an example of results of detection when the edge shape of the belt lateral end is detected by a plurality of sensors.
Figure 22:
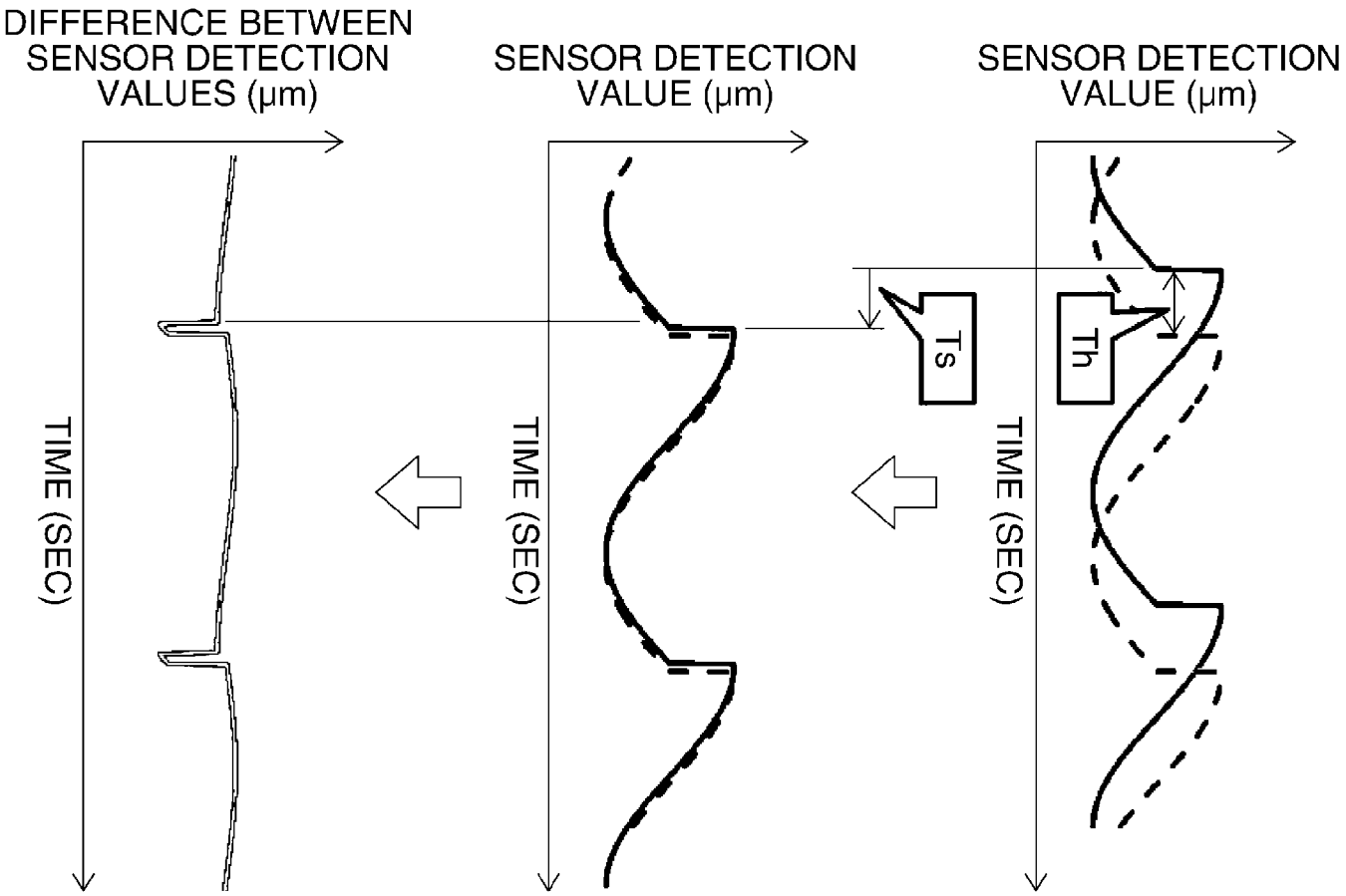
FIG. 22 RELATED ART
FIG. 22 is a diagram which is useful in explaining a result of calculation of a difference between the results of detection shown in FIG. 21.
Figure 23:
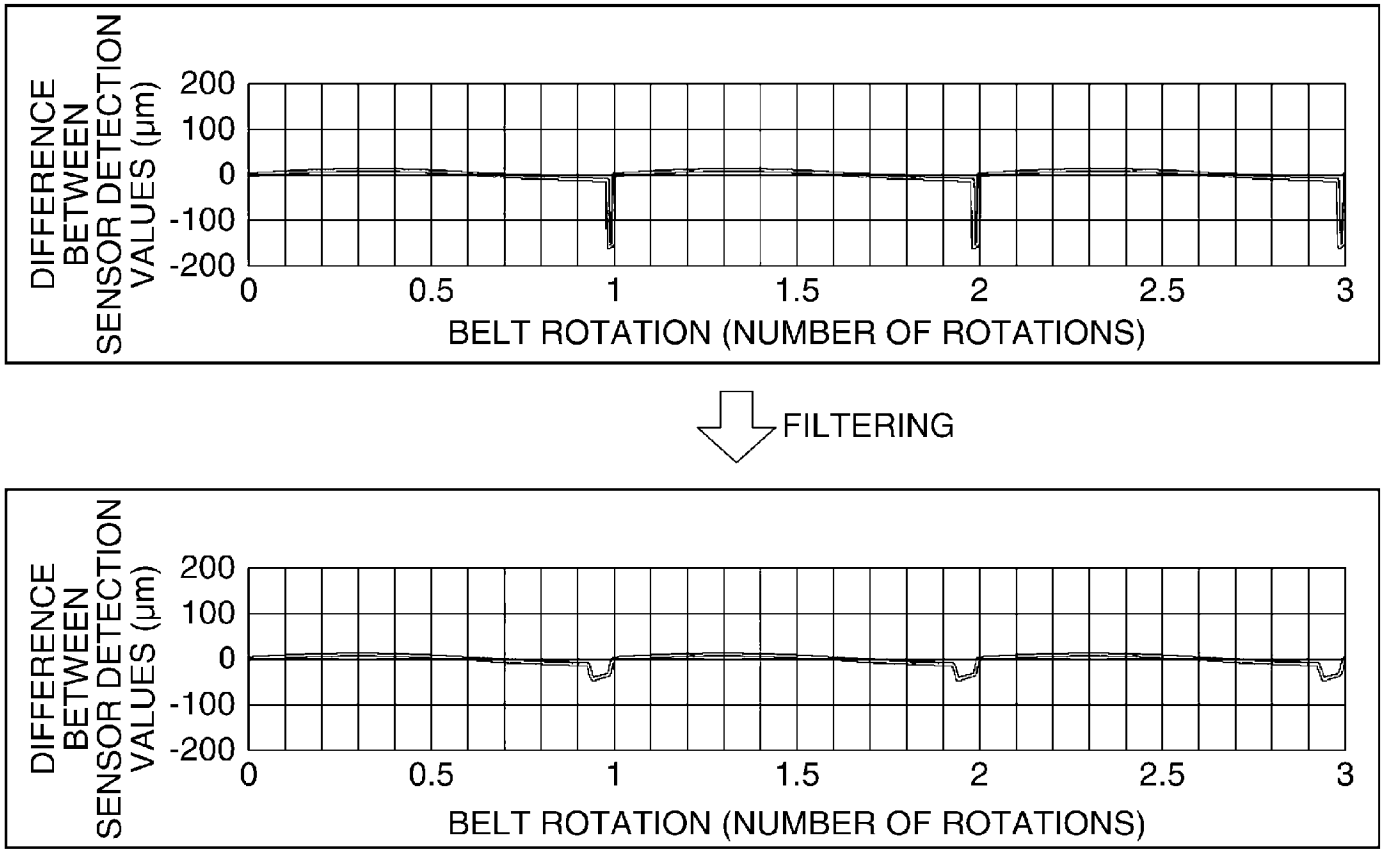
FIG. 23 RELATED ART
FIG. 23 is a diagram which is useful in explaining an example of a result of filtering which has been performed for eliminating impulse-like noise (glitch).

Incidentally, the controller 30 performs image writing correction based on the belt lateral end position indicated by the solid line in FIG. 12 or 14. In FIG. 12 or 14, a sine wave ascribable to the rotation period of the intermediate transfer belt 5 remains in the belt lateral end information. This sine wave is ascribable to a cut position displacement of the belt lateral end, which has occurred in the manufacturing process of the belt. To cope with this, in the present embodiment, as shown in FIG. 10B, a difference between the results of detection by the belt lateral end position detection sensors 10*a* and 10*b*, is determined. The reason for determining the difference between the results of detection by the belt lateral end position detection sensors 10*a* and 10*b* is as described hereinbefore with reference to FIGS. 20 to 22. Then, the filter (Filt 1) processing is performed on the difference to reduce impulse-like noise (glitch), and then the difference subjected to the filter processing is multiplied by the predetermined gain (G1) to thereby correct the difference subjected to the filter processing, whereafter, further, disturbance ascribable to the rotation period of the intermediate transfer belt 5 is reduced. The image writing correction value is determined based on this value in which disturbance is reduced.

Figure 15:
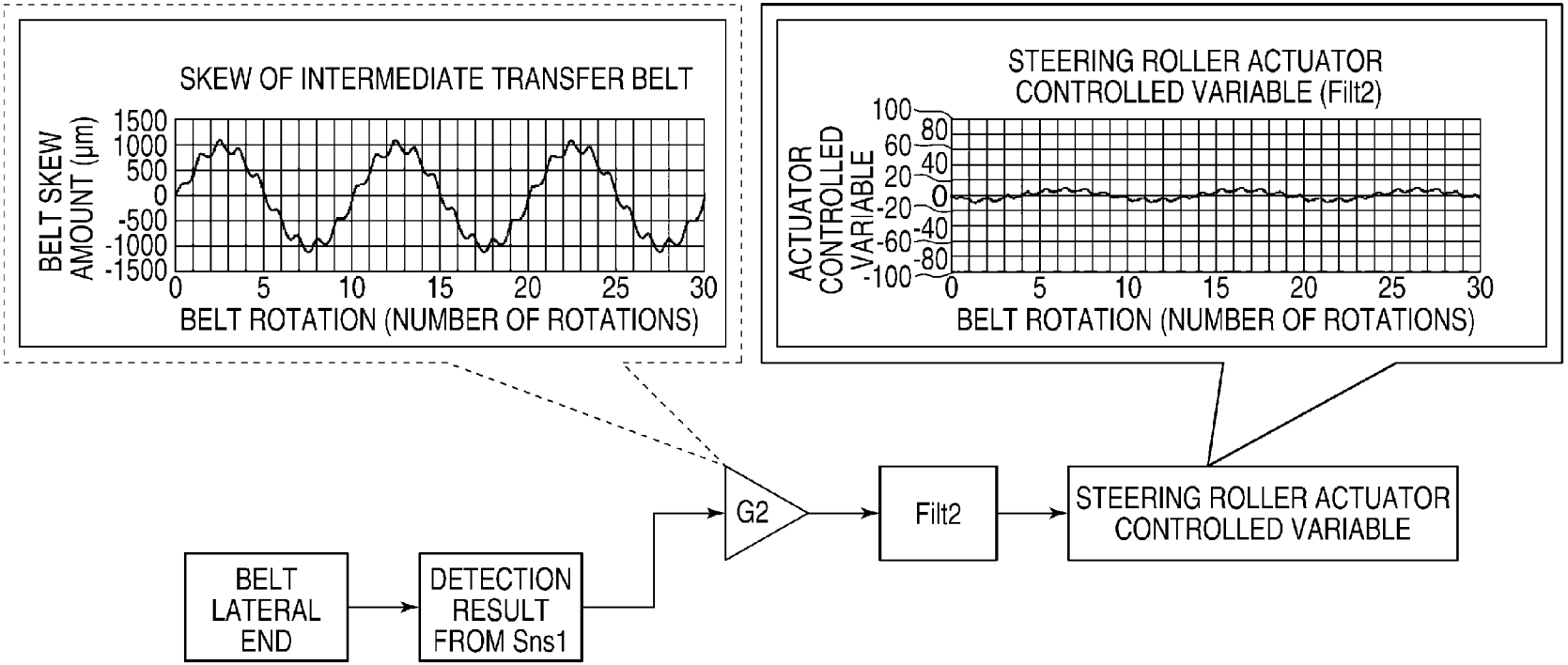
FIG. 15 is a diagram useful in explaining a third example of the driving amount calculated by the steering driving amount-calculating section.

To reduce the disturbance ascribable to the rotation period of the intermediate transfer belt 5, the steering driving amount-calculating section 30*a* in the present embodiment uses a filter (Filt 2) as shown in FIG. 15.

FIG. 15 is a diagram useful in explaining a third example of the driving amount calculated by the steering driving amount-calculating section 30*a* appearing in FIG. 3. This example shows a case where belt skew occurs at a period which is ten times the rotation period of the intermediate transfer belt 5.

The steering driving amount-calculating section 30*a* acquires an amount of belt skew by using the belt lateral end position detection sensor 10*a*. The steering driving amount-calculating section 30*a* multiplies the amount of belt skew by the predetermined gain (G2). Then, on the result of the multiplication, the steering driving amount-calculating section 30*a* performs filter (Filt 2) processing using the filter (Filt 2) having characteristics shown in FIG. 17 to thereby determine a controlled variable (driving amount). The controller 30 performs the skew control by controlling driving of the steering roller actuator 144 which is the control target, based on the controlled variable. The filter (Filt 2) processing will be described hereinafter. It is apparent from FIG. 15 that the amplitude of the controlled variable of the steering roller actuator 144 is largely reduced, compared with that shown in FIG. 11.

Figure 16:
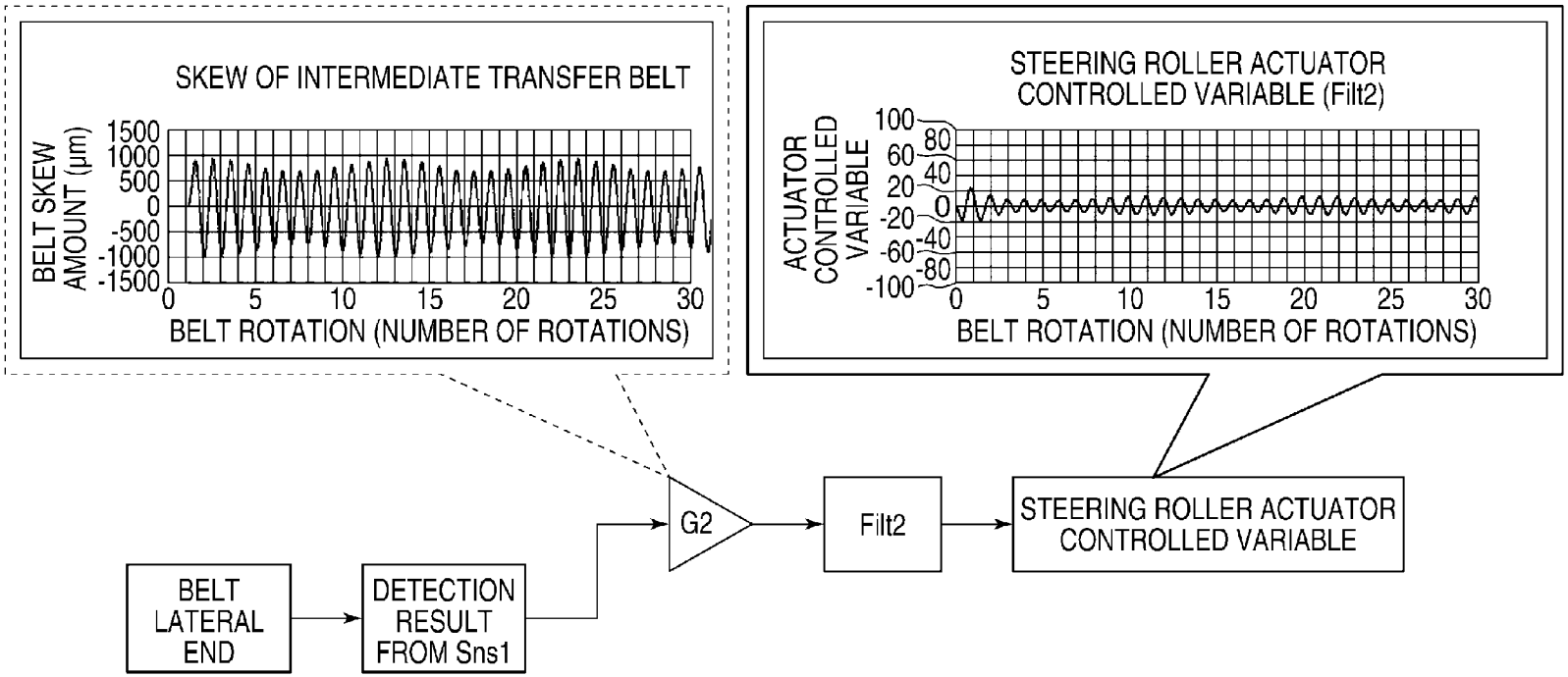
FIG. 16 is a diagram useful in explaining a fourth example of the driving amount calculated by the steering driving amount-calculating section.

FIG. 16 is a diagram useful in explaining a fourth example of the driving amount calculated by the steering driving amount-calculating section 30*a* appearing in FIG. 3. This example shows a case where belt skew occurs at a period which is one time the rotation period of the intermediate transfer belt 5.

The steering driving amount-calculating section 30*a* acquires a waveform on which a belt lateral end profile is superimposed at a period which is ten times the rotation period of the intermediate transfer belt 5, as an amount of belt skew, by using the belt lateral end position detection sensor 10*a*. Then, the steering driving amount-calculating section 30*a* determines a controlled variable (driving amount) of the steering roller actuator 144 that tilts the steering roller 14, based on the acquired amount of belt skew. More specifically, the steering driving amount-calculating section 30*a* multiplies the amount of belt skew by the predetermined gain (G2) and then performs the filter (Filt 2) processing on the result of the multiplication to thereby determine the controlled variable (driving amount). The controller 30 performs the skew control by controlling driving of the steering roller actuator 144 based on the controlled variable.

It is apparent from FIG. 16 that the amplitude of the controlled variable of the steering roller actuator 144 is largely reduced, compared with that of the steering roller actuator controlled variable shown in FIG. 13.

As described above, by performing the filter (Filt 2) processing, it is possible to reduce the amplitude of the controlled variable, i.e. the driving amount.

The filter (Filt 2) used in the above-described filtering is referred to as the band stop filter.

Figure 17:
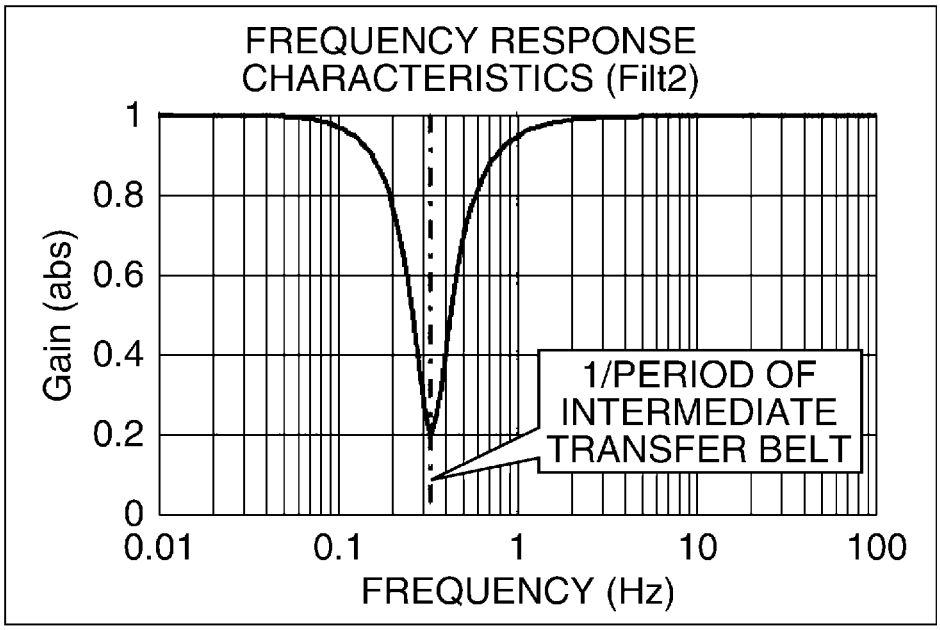
FIG. 17 is a diagram showing characteristics of a band stop filter used by the steering driving amount-calculating section.

FIG. 17 is a diagram showing the characteristics of the band stop filter used by the steering driving amount-calculating section 30*a* appearing in FIG. 3.

The band stop filter is a filter having frequency response characteristics that reduce the gain at a predetermined target frequency. In the present embodiment, the frequency (reciprocal of one period) of rotation of the intermediate transfer belt is approximately 0.33 Hz. At a frequency of rotation of the intermediate transfer belt, the filter (Filt 2) of the present embodiment reduces the gain (i.e. the control gain) to approximately 1/5, compared with other frequency bands.

Figure 18:
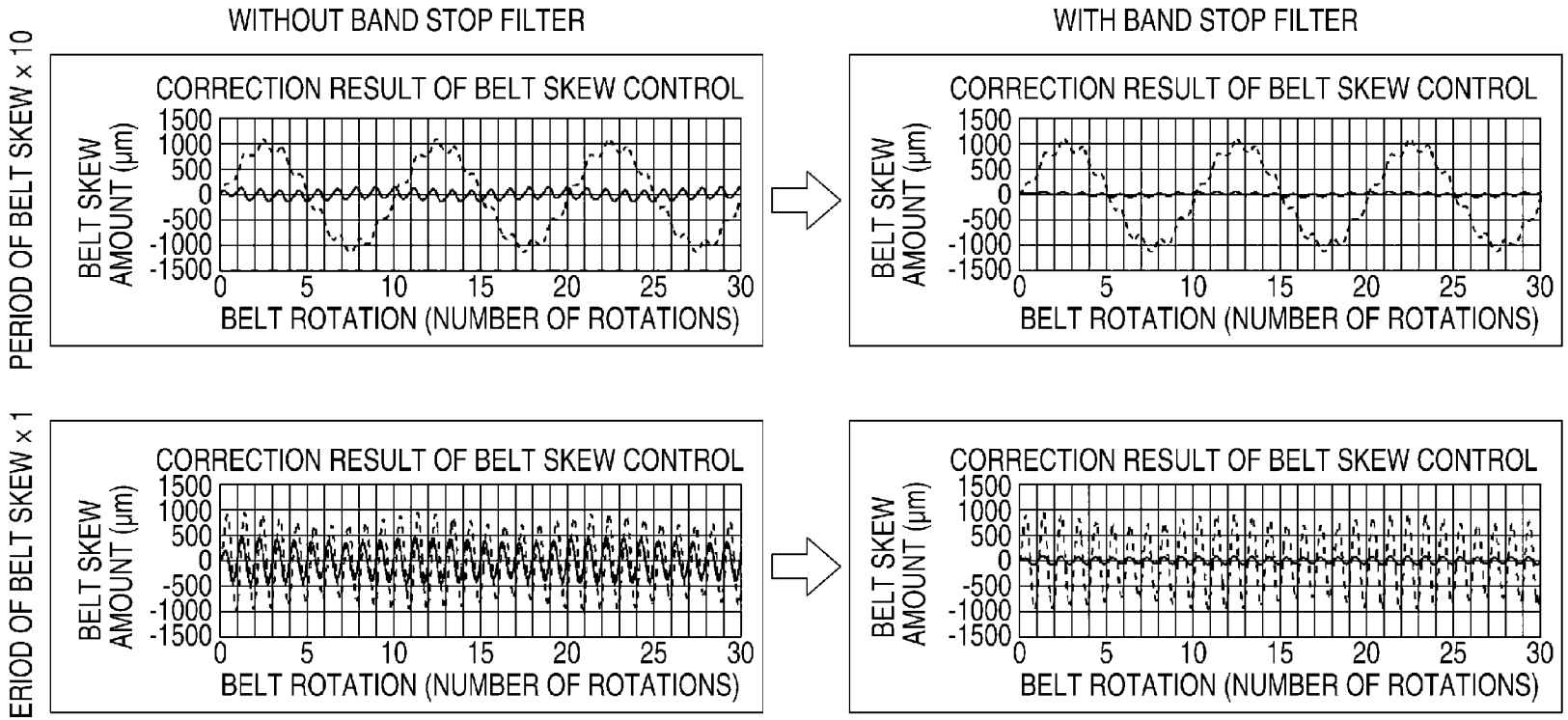
FIG. 18 is a diagram useful in explaining an effect obtained when the band stop filter, shown in FIG. 17, is used.

FIG. 18 is a diagram useful in explaining effects obtained when the band stop filter shown in FIG. 17 is used.

The illustrated examples show variations in the belt lateral end position detected in respective cases where the band stop filter is provided and where the same is not provided. In each case, there is shown an example in which the belt skew period is ten times the rotation period of the belt and an example in which the belt skew period is one time the same. Each broken line indicates a result of detection of variations in the belt lateral end position when the skew control is not performed. Each solid line indicates a result of detection of variations in the belt lateral end position when the skew control is performed.

The control of the steering roller actuator 144 is not responsive to detection results at the belt rotation period, and hence it is clear from FIG. 18 that as a result of band stop filtering, the amplitude of variations in skew at the belt rotation period is suppressed. Further, it is clear that when band stop filtering is performed, the amplitude of variations in skew is sufficiently suppressed by the skew control in the components of variations in skew at periods other than the belt rotation period.

That is, by using the band stop filter shown in FIG. 17 to perform the skew control of the intermediate transfer belt 5, it is possible to reduce the influence of variations in the belt lateral end position ascribable to a cut position displacement of the belt lateral end, which has occurred in the manufacturing process of the belt.

Figure 19:
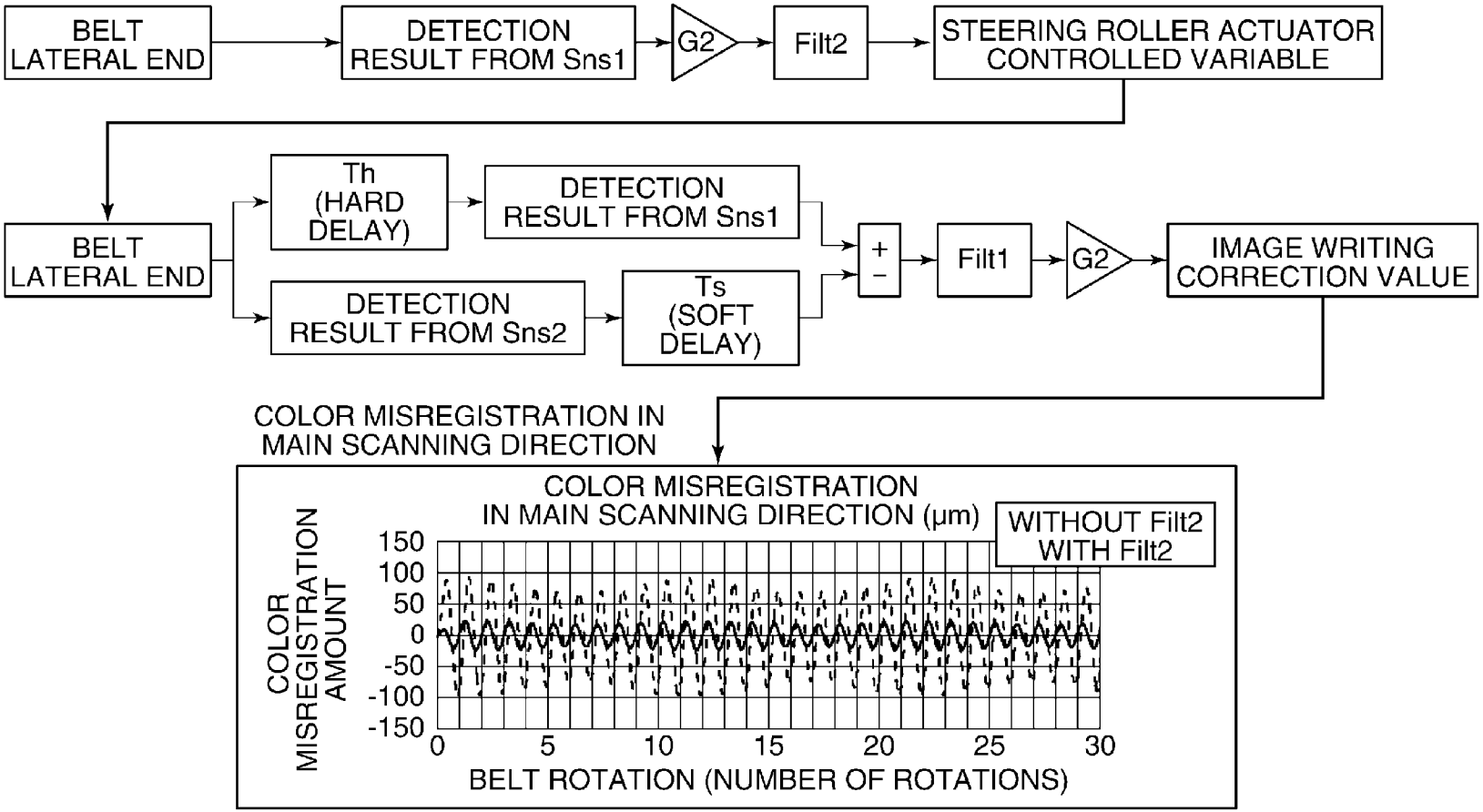
FIG. 19 is a diagram of a control system as a combination of the control system shown in FIG. 10B and the control system shown in FIG. 15, for generating an image writing correction value and a controlled variable.

FIG. 19 is a diagram of a control system formed by combining the control system shown in FIG. 10B and the control system shown in FIG. 15, for generating an image writing correction value and generating a controlled variable.

As shown in FIG. 19, the filter (Filt 1) for adjusting the image writing timing and the band stop filter (Filt 2) for controlling the steering roller actuator 144 are used in combination. In the illustrated example, the driving of the steering roller actuator 144 is controlled according to the controlled variable of the steering roller actuator 144. The image writing correction is performed based on a result of detection of the belt lateral end on which the skew control is performed by the steering roller 14 of which the driving is controlled as described above.

The image writing correction value is calculated according to the result of detection of the belt lateral end after the drive control, as described with reference to FIG. 10B, whereby the image writing timing is controlled. This makes it possible to reduce color misregistration in the main scanning direction as shown in FIG. 19, and thereby obtain an excellent image.

As described above, in the embodiment of the present invention, it is possible to obtain an excellent image having less color misregistration, without reducing the accuracy of adjustment of image formation timing, by eliminating disturbance occurring at the belt rotation period ascribable to a level difference due to cutting position displacement (step at cut position) and the like of the intermediate transfer belt.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

For example, a control method based on the functions of the above-described embodiment may be caused to be executed by the image forming apparatus.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

This application claims the benefit of Japanese Patent Application No. 2016-096156 filed May 12, 2016, which is hereby incorporated by reference herein in its entirety.

What is claimed is:

1. An image forming apparatus comprising:

a first image forming station configured to form a first image of a first color;

a second image forming station configured to form a second image of a second color;

an intermediate transfer member configured to have the first image and the second image transferred thereon;

a transfer portion configured to transfer the first image and the second image transferred on the intermediate transfer member to a recording medium;

a first sensor configured to detect a position of a predetermined portion of the intermediate transfer member at a first location;

a second sensor configured to detect a position of the predetermined portion of the intermediate transfer member at a second location different from the first location in a direction of movement of the intermediate transfer member;

a steering mechanism configured to adjust a posture of the intermediate transfer member;

a first filter configured to perform smoothing processing on posture data determined based on a result of detection by the first sensor and a result of detection by the second sensor;

a second filter configured to perform band stop filter processing on the result of detection by the second sensor; and a controller configured to control the steering mechanism based on a result of processing by the second filter, and control a forming position of the second image based on a result of processing by the first filter.

2. The image forming apparatus according to claim 1, wherein the band stop filter processing reduces disturbance ascribable to a rotation frequency of the intermediate transfer member.

3. The image forming apparatus according to claim 1, wherein the second image is superimposed on the first image on the intermediate transfer member, wherein the intermediate transfer member is a belt, and the belt is stretched over a plurality of rollers;

wherein the steering mechanism controls a posture of the roller, out of the plurality of rollers, which is positioned downstream of the second image forming station in a direction of rotation of the intermediate transfer member; and wherein the second location is located downstream of the first location in the direction of rotation of the intermediate transfer member, and is closer to a roller, out of the plurality of rollers, which is controlled by the steering mechanism, than the first location.

4. The image forming apparatus according to claim 1, wherein the result of detection by the second sensor, which is used by the first filter, is the result of detection after a predetermined time period elapses from detection by the first sensor, and wherein the predetermined time period is a time period determined such that the result of detection by the first sensor and the result of detection by the second sensor after the predetermined time period are results of detection of the same portion of the intermediate transfer member.

5. The image forming apparatus according to claim 1, further comprising a patch detection sensor configured to detect patches on the intermediate transfer member, and wherein the controller controls the forming position of the second image, based on results of detection, by the patch detection sensor, of first and second patches formed on the intermediate transfer belt by the first image forming station and the second image forming station, respectively.

6. The image forming apparatus according to claim 1, wherein the intermediate transfer member is a belt, and the predetermined portion is a lateral end of the belt.

7. The image forming apparatus according to claim 1, wherein the smoothing processing performs moving averaging processing.

8. The image forming apparatus according to claim 1, wherein the controller controls the forming position of the second image in a main scanning direction which is a direction intersecting with the direction of movement of the intermediate transfer member, based on the result of processing by the first filter.

9. The image forming apparatus according to claim 1, wherein the first filter performs the smoothing processing on difference data between the result of detection by the first sensor and the result of detection by the second sensor.

* * * * *